US005791405A

United States Patent [19]

Takiura et al.

[11] Patent Number: 5,791,405

[45] Date of Patent: Aug. 11, 1998

[54] HEAT TRANSFER TUBE HAVING GROOVED INNER SURFACE

[75] Inventors: Masayoshi Takiura; Seizo Masukawa; Haruo Kohno; Shunroku Sukumoda, all of Aizuwakamatsu, Japan

[73] Assignee: Mitsubishi Shindoh Co., Ltd., Tokyo, Japan

[21] Appl. No.: 680,215

[22] Filed: Jul. 11, 1996

[30] Foreign Application Priority Data

| | | | |
|---|---|---|---|
| Jul. 14, 1995 | [JP] | Japan | 7-179254 |
| Aug. 1, 1995 | [JP] | Japan | 7-196880 |
| Aug. 14, 1995 | [JP] | Japan | 7-207111 |

[51] Int. Cl.[6] ..... F28F 1/14

[52] U.S. Cl. ..... 165/184; 165/133; 165/181

[58] Field of Search ..... 165/133, 179, 165/181, 184

[56] References Cited

U.S. PATENT DOCUMENTS

| | | | |
|---|---|---|---|
| 3,088,494 | 5/1963 | Koch et al. | 165/179 |
| 3,750,709 | 8/1973 | French | 165/179 X |
| 4,480,684 | 11/1984 | Onishi et al. | 165/179 X |
| 4,705,103 | 11/1987 | Zogg et al. | 165/179 X |
| 5,010,643 | 4/1991 | Zohler | 165/133 X |
| 5,259,448 | 11/1993 | Masukawa et al. | 165/179 X |
| 5,586,598 | 12/1996 | Tanaka et al. | 165/133 |
| 5,655,599 | 8/1997 | Kasprzyk | 165/184 X |

FOREIGN PATENT DOCUMENTS

| | | | |
|---|---|---|---|
| 61-0006595 | 1/1986 | Japan | 165/179 |
| 63-0172893 | 7/1988 | Japan | 165/179 |

*Primary Examiner*—Ira S. Lazarus
*Assistant Examiner*—Christopher Atkinson
*Attorney, Agent, or Firm*—Pearne, Gordon, McCoy and Granger LLP

[57] ABSTRACT

The present invention has the object of increasing the heat exchanging performance of heat transfer tubes having grooved inner surfaces. In order to achieve this object, the heat transfer tubes having grooved inner surfaces according to the present invention have fins which are formed consecutively in a circumferential direction on the inner surface of a metallic tube. The inner surface of the metallic tube is divided into regions R1~R4 in the circumferential direction. The inclination angle α with respect to the axis of the heat transfer tube of the fins 2 in odd-numbered regions when counting from one of the regions is 10°~25°, and the inclination angle β with respect to the axis of the heat transfer tube of the fins 2 in even-numbered regions when counting from the region is −10°—25°. The pitch of the fins 2 is 0.3~0.4 mm, the height of the fins from the inner circumferential surface of the metallic tube is 0.15~0.30 mm, and the angle formed between the side surfaces of each fin is 10°~25°.

15 Claims, 31 Drawing Sheets

(EVAPORATION PERFORMANCE TEST)

(CONDENSATION PERFORMANCE TEST)

HEAT TRANSFER TUBE HAVING GROOVED INNER SURFACE

BACKGROUND OF THE INVENTION

1. Technical Field of the Invention

The present invention relates to heat transfer tubes having grooved inner surfaces, which are used in heat exchangers and the like in air conditioners or cooling apparatus.

2. Background Art

These types of heat transfer tubes having grooved inner surfaces are primarily used as evaporation tubes or condenser tubes in heat exchangers and the like in air conditioners or cooling apparatus. Recently, heat transfer tubes having spiraling fins formed over the entire inner surface have been widely marketed.

The heat transfer tubes which are currently most popular are manufactured by a method wherein fins are roll-formed over the entire inner surface of a metallic tube by passing a floating plug, having spiral grooves formed on the outer circumferential surface, along the interior of a seamless tube obtained by a drawing or an extrusion process. In the heat transfer tubes having outer diameters of approximately 10 mm which are commonly used, the height of the fins is about 0.15~0.20 mm, the pitch of the fins (the distance between the tops of adjacent fins) is about 0.45~0.55 mm, and the bottom width of the grooves formed between the fins is about 0.20~0.30 mm.

In heat transfer tubes having grooved inner surfaces with spiral fins of this type, heat transfer liquid which has collected to the bottom of the interior of the heat transfer tube is drawn up along the spiral fins by being blown by a vapor current which flows inside the tube, thereby spreading along the entire circumferential surface inside the tube. Due to this effect, the entire circumferential surface inside the tube is made almost uniformly wet, so that the area wherein boiling occurs can be increased to improve the boiling efficiency when the tube is used as an evaporation tube for vaporizing the heat transfer liquid. Additionally, when using the tube as a condenser tube for liquefying heat transfer gas, the condensation efficiency can be increased by increasing the contact efficiency between the metallic surfaces and the heat transfer gas due to the tips of the fins being exposed from the surface of the liquid.

However, it is apparent that there is room for improvement in the heat transfer efficiency due to the spiral fins. Therefore, the present inventors produced many types of heat transfer tubes having grooved inner surfaces by changing the patterns of the grooves in the heat transfer tubes, then performed experiments to compare their performance. As a result, they discovered that better heat transfer performance can be obtained in comparison to other groove patterns, if the angle of inclination of the fins formed on the inner surface of the heat transfer tubes is reciprocally changed in the circumferential direction or the axial direction.

SUMMARY OF THE INVENTION

A first object of the present invention is to provide excellent heat exchanging performance. In order to achieve this object, the present invention offers a heat transfer tube having a grooved inner surface; comprising a plurality of fins consecutively formed along a circumferential direction on an inner circumferential surface of a metallic tube; wherein said inner circumferential surface of said metallic tube is divided into at least two regions in the circumferential direction; an inclination angle of said fins is 10°~25° with respect to an axis of said metallic tube inside odd-numbered regions counting from one region among said regions, and an inclination angle of said fins is −10°~25° with respect to the axis of said metallic tube inside even-numbered regions counting from said one region.

With the grooved-inner-surface heat transfer tube of the present invention, the fins formed on the inner surface are arranged so as to form at least one pair of V-shapes which open up in the upstream direction of flow of the heat transfer medium, so that the heat transfer medium which flows along the side surfaces of the fins is combined at the adjoining portion of the V-shape, and flows over this adjoining portion. During this process, the heat transfer fluid is agitated to create a chaotic turbulent flow, thereby preventing the occurrence of temperature gradients in the flow of the heat transfer medium. This promotes heat exchange between the heat transfer medium and the metallic surfaces so as to allow increases in the heat transfer efficiency.

A second object of the present invention is to reduce pressure loss in the heat transfer medium flowing through the grooved-inner-surface heat transfer tube while obtaining a high eat exchange efficiency. This object is achieved by a second grooved-inner-surface heat transfer tube of the present invention, wherein gaps are formed between the bending portions of zigzag-shaped fins.

According to this type of grooved-inner-surface heat transfer tube, gaps are formed between the end portions of the fins, so that heat transfer fluid is able to escape through these gaps so as to hold down the pressure loss without being affected by the rate of increase in the heat transfer efficiency.

A third grooved-inner-surface heat transfer tube of the present invention comprises a metallic tube having a plurality of fins, which are inclined with respect to the axial direction of said metallic tube, formed on an inner circumferential surface thereof; wherein the orientation of an inclination angle of said fins with respect to the axial direction is reversed every designated interval in said axial direction.

According to a grooved-inner-surface heat transfer tube of this type, the direction of advancement of heat transfer medium flowing through the heat transfer tube is inclined by the fins. As a result, the heat transfer medium is agitated so as to promote heat exchange between the grooved-inner-surface heat transfer tube and the heat transfer medium, while the direction of advancement of the heat transfer medium flow is again changed by the fins at the next region by fins of an opposite inclination angle even if the heat transfer medium is concentrated at standard locations on the inner surface of the grooved-inner-surface heat transfer tube during this agitation stage, thereby allowing the heat transfer medium to be agitated once again. In this way, the direction of flow of the heat transfer medium is forcibly changed to repeat an agitation effect at designated intervals, thus allowing the heat exchange efficiency to be increased.

A fourth object of the present invention is to prevent localized thinning from occurring on the surface of the grooved-inner-surface heat transfer tube even when a rounding procedure is performed on the grooved-inner-surface heat transfer tube. In order to achieve this object, a fourth grooved-inner-surface heat transfer tube of the present invention comprises a plurality of fins consecutively formed along a circumferential direction on an inner circumferential surface of a metallic tube; wherein said inner circumferential surface of said metallic tube is divided into at least two regions in the circumferential direction; an inclination angle of said fins has a positive value with respect to an axis of said metallic tube inside odd-numbered regions counting from one region among said regions, and an inclination angle of said fins has a negative value with respect to the axis of said metallic tube inside even-numbered regions counting from said one region; and ribs are formed for coupling bending points on said fins which are adjacent in an axial direction of said metallic tube.

According to a grooved-inner-surface heat transfer tube of this type, ribs are formed to couple bending points in the zigzag-shaped fins, thereby preventing the gaps between the bending portions of the fins from spreading inordinately in comparison to other portions by means of the tensile strength of the ribs, even when the grooved-inner-surface heat transfer tube is being rounded. Consequently, the area around the tapered end portions of the fins does not bulge out from the outer surface of the grooved-inner-surface heat transfer tube to form bumps, and it is possible to prevent blemishes in the outward appearance due to the formation of such bumps and the prevent reductions in the reliability of the grooved-inner-surface heat transfer tube due to thinning at the bumps.

A fifth object of the present invention is to easily produce a grooved-inner-surface heat transfer tube wherein localized thinning does not occur on the surface of the grooved-inner-surface heat transfer tube, even when a rounding process in performed.

In order to achieve this object, roller for producing heat transfer tubes having grooved inner surfaces according to the present invention comprises at least two layered roller components, each having a plurality of grooves formed at an incline with respect to a circumferential direction on an outer circumferential surface thereof; wherein the orientations of the angles of grooves with respect to said circumferential direction formed on the outer circumferential surfaces of adjacent roller components are mutually opposite; and both edges in an axial direction of each of said roller components are chamfered.

PREFERRED EMBODIMENTS OF THE INVENTION

Embodiment 1

Figure 1:
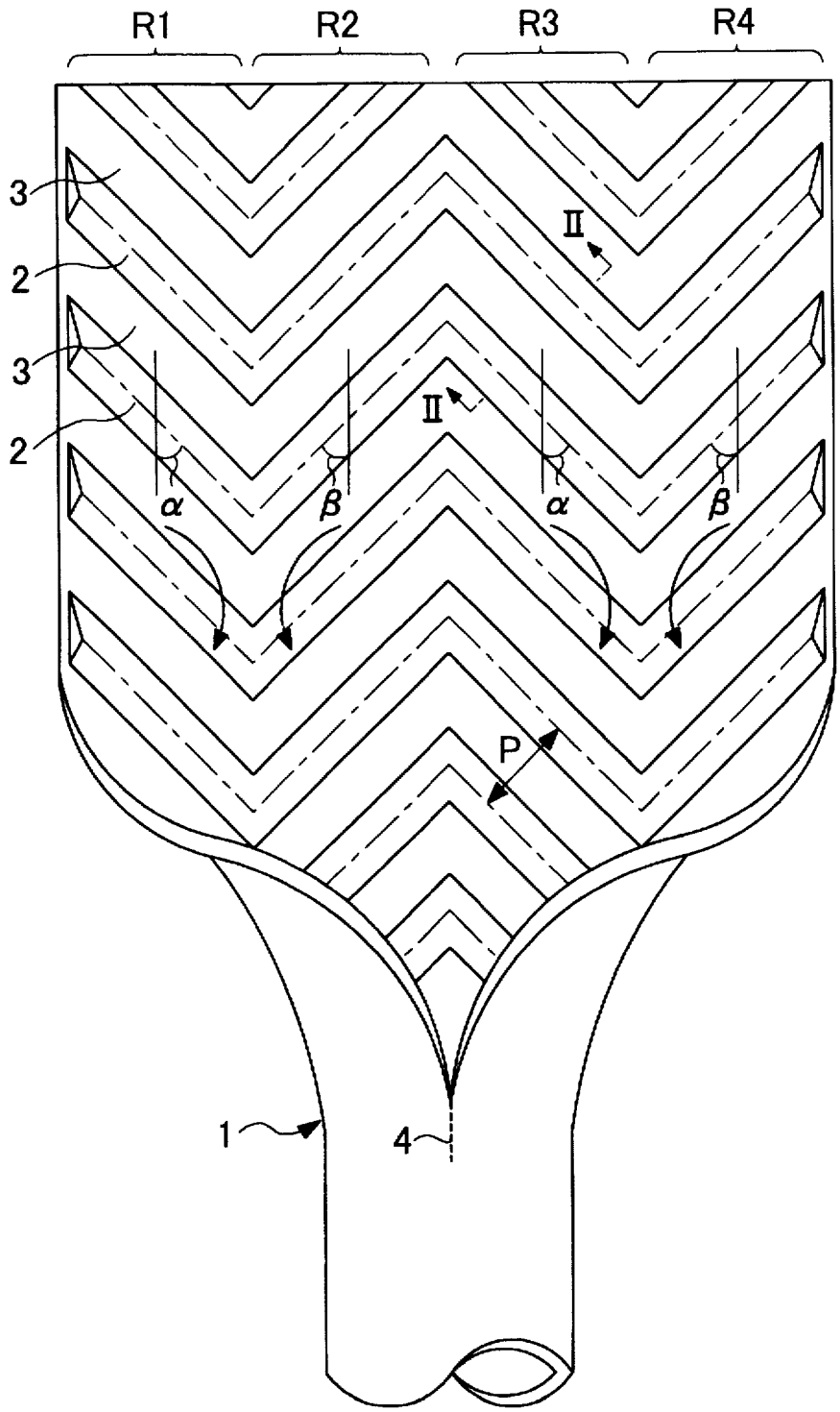
FIG. 1 is a plan view showing an embodiment of a heat transfer tube having a grooved inner surface according to an embodiment of the present invention, wherein the inner surface of the tube has been partially spread open.

FIG. 1 is a plan view showing an embodiment of a heat transfer tube having a grooved inner surface according to an embodiment of the present invention, wherein the inner surface of the tube has been partially spread open. A plurality of parallel fins 2 which extend in zigzag fashion in the circumferential direction are formed on the inner circumferential surface of this grooved-inner-surface heat transfer tube 1, with groove portions 3 formed between the fins 2. A single weld line 4 which extends in the axial direction is formed on the inner surface of the grooved-inner-surface heat transfer tube 1, and the fins are divided by this weld line. This weld line 4 should preferably protrude by an amount less than the amount of protrusion of the fins 2.

The grooved-inner-surface heat transfer tube 1 of the present invention has its principal characteristic in the arrangement of the fins. That is, the inner surface of this heat transfer tube 1 is divided into four regions R1~R4 each being 90° in the circumferential direction, wherein the odd regions R1 and R3 counting from any one of the regions (R1 in this case) have fins 2 which are formed so as to make a positive angle $\alpha$, preferably 10°~25°, with respect to the axis of the heat transfer tube, while the even regions R2 and R4 have fins 2 which are formed so as to make a negative angle $\beta$, preferably −10°—25°, with respect to the axis of the heat transfer tube. When the inclination angles $\alpha$ and $\beta$ of the fins 2 exceed an absolute value of 25°, they become close to perpendicular with respect to the flow, so that they tend to obstruct the flow and increase the pressure loss. Additionally, when the inclination angles $\alpha$ and $\beta$ of the fins 2 have absolute values less than 10°, they become close to parallel to the flow, so that the turbulence generating effect of the fins 2 is reduce.

The orientation of the inclination angles $\alpha$ and $\beta$ may also be reversed, and it is only necessary that the fins 2 be inclined in reciprocally opposite directions with respect to the axis of the heat transfer tube every designated length so that they form an overall zigzag pattern. Whereas the fins 2 within the same region are mutually parallel in the example of FIG. 1, they are not necessarily restricted to being parallel, so that the inclination angles may differ between fins within the range of angles mentioned above.

Figure 2:
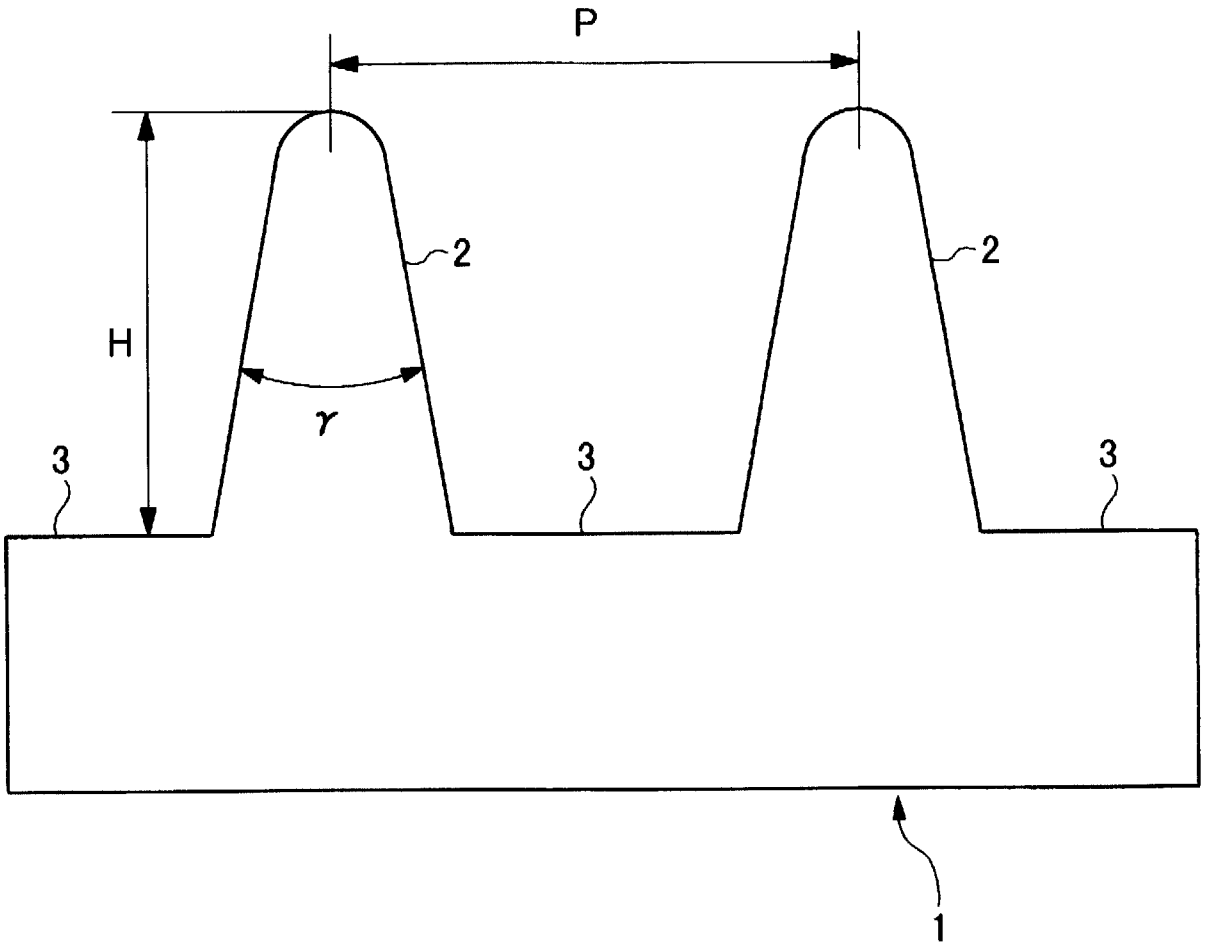
FIG. 2 is a section view cut along the line II—II in FIG. 1.

While the cross-sectional shapes and measurements of the fins 2 are not restricted, the fins 2 of a region should preferably have a pitch P of 0.3~0.4 mm, more preferably 0.34~0.37 mm, and the height H of the fins 2 from the inner surface of the metallic tube should be 0.15~0.30 mm, more preferably 0.21~0.26 mm, as shown in FIG. 2. When the fins are made taller than in conventional products in this manner, the turbulence generation effect is improved, so as to work together with the effect given by the zigzag arrangement of the fins 2 to increase the heat transfer effect of the heat transfer tube 1.

Additionally, these types of thin and tall fins 2 improve the drainage at the tips of the fins 2 when the inner surface of the metallic tube 1 is covered with heat transfer fluid, so that the metallic surfaces at the tips of the fins 2 easily make direct contact with the heat transfer gas when it is used as a condensation tube, thereby resulting in excellent condensation performance.

The angle $\gamma$ (apex angle) between the side surfaces of the fins 2 is not necessarily restricted but should preferably be 10°~25°, and more preferably 15°~20°. When the apex angle of the fins 2 is small in this way, the side surfaces of the fins 2 stand almost vertically upright from the inner surface of the tube, so that aside from the portions which form a V-shaped trough from the upstream side of the heat transfer medium with respect to the fins 2, the heat transfer fluid is not blown to the tops of the fins 2 by means of wind pressure from the heat transfer gas flowing through the heat transfer tube 1. Consequently, not only is the flow of heat transfer fluid controlled by means of the fins 2 to increase the turbulence generation effect, but the probability of the tip portion of each fin 2 being exposed is increased when the heat transfer tube 1 is used as a condensation tube, so that the contact area between the heat transfer gas and the metallic surface is increased to obtain a higher condensation rate. Additionally, while the tops of the fins 2 have a semicircular cross-section in the example shown in the drawings, they may have a cross-sectional trapezoidal shape or a cross-sectional triangular shape in the present invention.

The dimensions of the heat transfer tube 1 such as the outer diameter, thickness and length are not restricted, and heat transfer tubes of any dimensions conventionally used are capable of being applied to the present invention. While copper or a copper alloy is usually used as the material for heat transfer tubes 1, the present invention is not so restricted, and any type of metal may be used, such as aluminum. While the cross-sectional shape of the heat transfer tube 1 of this embodiment is circular, the present invention is not restricted to having a circular cross-section, and may have an oval cross-section or be a flat tube. Furthermore, it is also effective when used as the main body of a heat tube.

The following method can be used to produce a grooved-inner-surface heat transfer tube of this type. First, a strip of metallic board material is prepared and this is passed between a milling roller and a receiving roller having cross sections complementing the shapes of the fins 2 and the grooved portions 3, thereby simultaneously forming the fins 2 and the grooved portions 3 on the surface of the board material. As for the above-mentioned milling roller, a layered roller having milling rollers with spiral grooves for forming the fins 2 and the groove portions 3 stacked with the directions of the spirals reciprocally reversing may be used, in which case the shape of each portion can be arbitrarily set by exchanging the rollers which are layered.

Next, the metallic board material having the fins and groove portions 3 transferred thereon is set on an electrical seam welding apparatus with the grooved surface facing inward, so that the board material is rounded in the lateral direction by passing through multiple stages of molding rollers, and finally the side edge portions 4 which have been adjoined are welded together to form the groove-inner-surface heat transfer tube 1. At this time, a weld line 4 corresponding to the side edge portions 4 is formed on the inner surface of the tube. The electrical seam welding apparatus may be any type which is generally used, and the seam welding conditions can be identical to those of the usual process. Then, after the welded portion on the outer surface of the heat transfer tube has been shaped, the heat transfer tube is wound into a roll or cut at designated lengths.

With the grooved-inner-surface heat transfer tube 1 according to the above structure, the fins 2 formed on the inner surface are arranged so as to make two V-shapes in the upstream direction of flow with respect to a heat transfer medium which flows in either direction, so that the heat transfer medium which is collected by the side surfaces of each fin 2 combine at the adjoining portions of the V-shapes, then go over the adjoining portions to flow onward. Due to this process, the heat transfer medium is agitated to form a chaotic turbulent flow, thereby preventing temperature gradients from forming within the flow of the heat transfer medium, so as to promote heat exchange between the heat transfer medium and the metallic surfaces of the heat transfer tube and increase the heat transfer efficiency. Specifically, when a mixed heat transfer medium (a mixture of a plurality of heat transfer media) is used, the components of the heat transfer medium can be prevented from separating to draw out the original properties of the mixed heat transfer medium.

Embodiment 2

Figure 3:
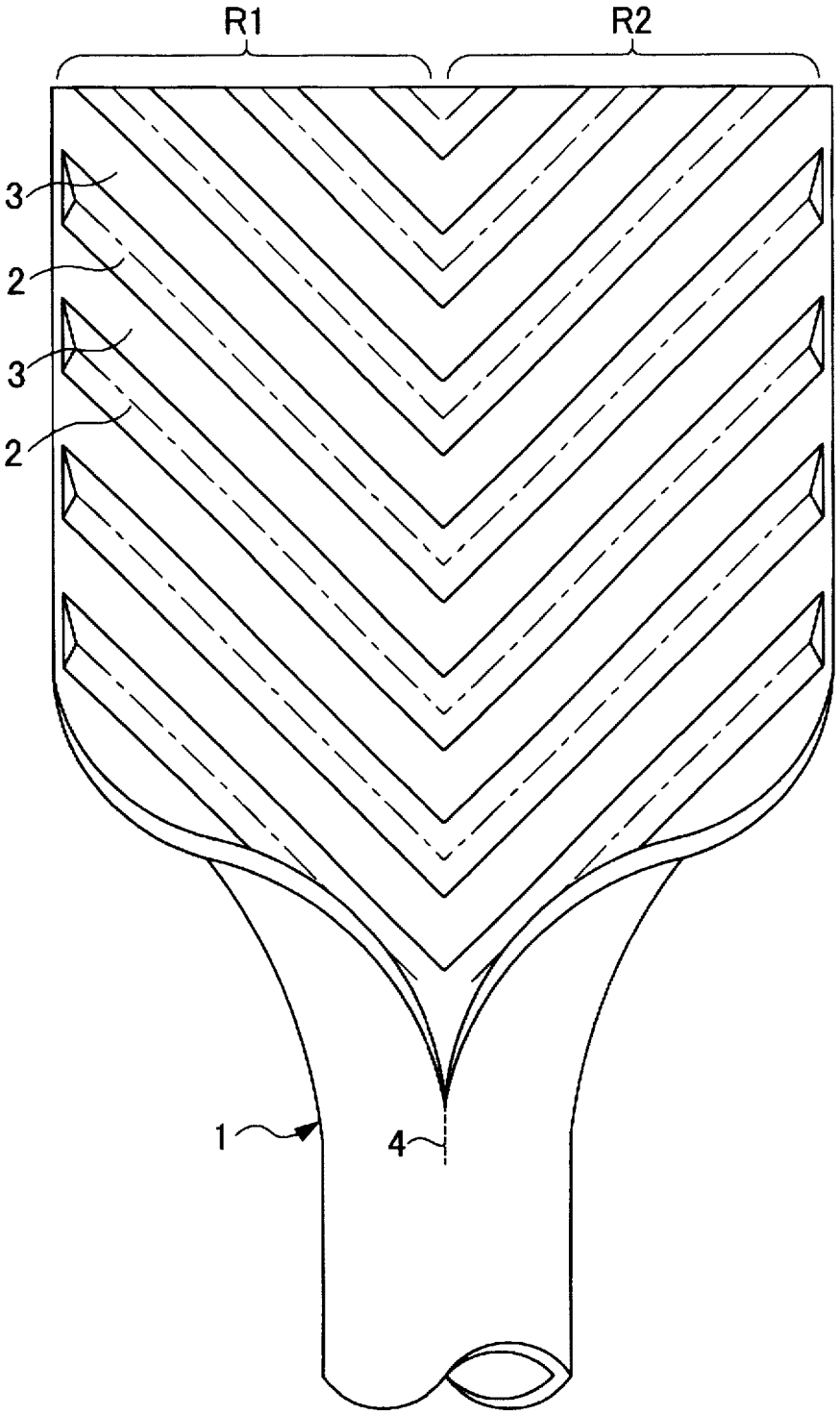
FIG. 3 is a plan view showing another embodiment of the present invention wherein the inner surface of the tube has been partially spread open.

FIG. 3 shows a second embodiment of the present invention. In Embodiment 1, the inner surface of the heat transfer tube 1 is divided into four regions R1~R4 in the circumferential direction; in the present embodiment, it is divided into only two regions R1 and R2 in the circumferential direction. Therefore, if the outer diameter of the heat transfer tube is identical, then the length of the fins 2 is approximately doubled in comparison to the previous embodiment. With regard to the other features, they are identical to the previous embodiment.

According to Embodiment 2, the fins 2 formed on the inner surface are arranged so as to form a single V-shape in the upstream direction of flow with respect to a heat transfer medium flowing in either direction, so that the heat transfer medium collects at portions corresponding to the troughs of the V-shapes. In order to take advantage of this property, the up/down orientation of the heat transfer tube 1 should preferably be set depending upon the application with Embodiment 2.

For example, when used as a condensation tube, the metallic surface and the heat transfer medium should preferably be put into direct contact, so the portion corresponding to the trough of the V-shape with respect to the vapor current should face downwards. Consequently, it becomes difficult for the heat transfer fluid which collects and flows inside the heat transfer tube 1 to spread along the fins 2 to the top side of the inner surface of the heat transfer tube 1, so that this works together with the above-mentioned effect to increase the condensation efficiency.

Embodiment 3

Figure 4:
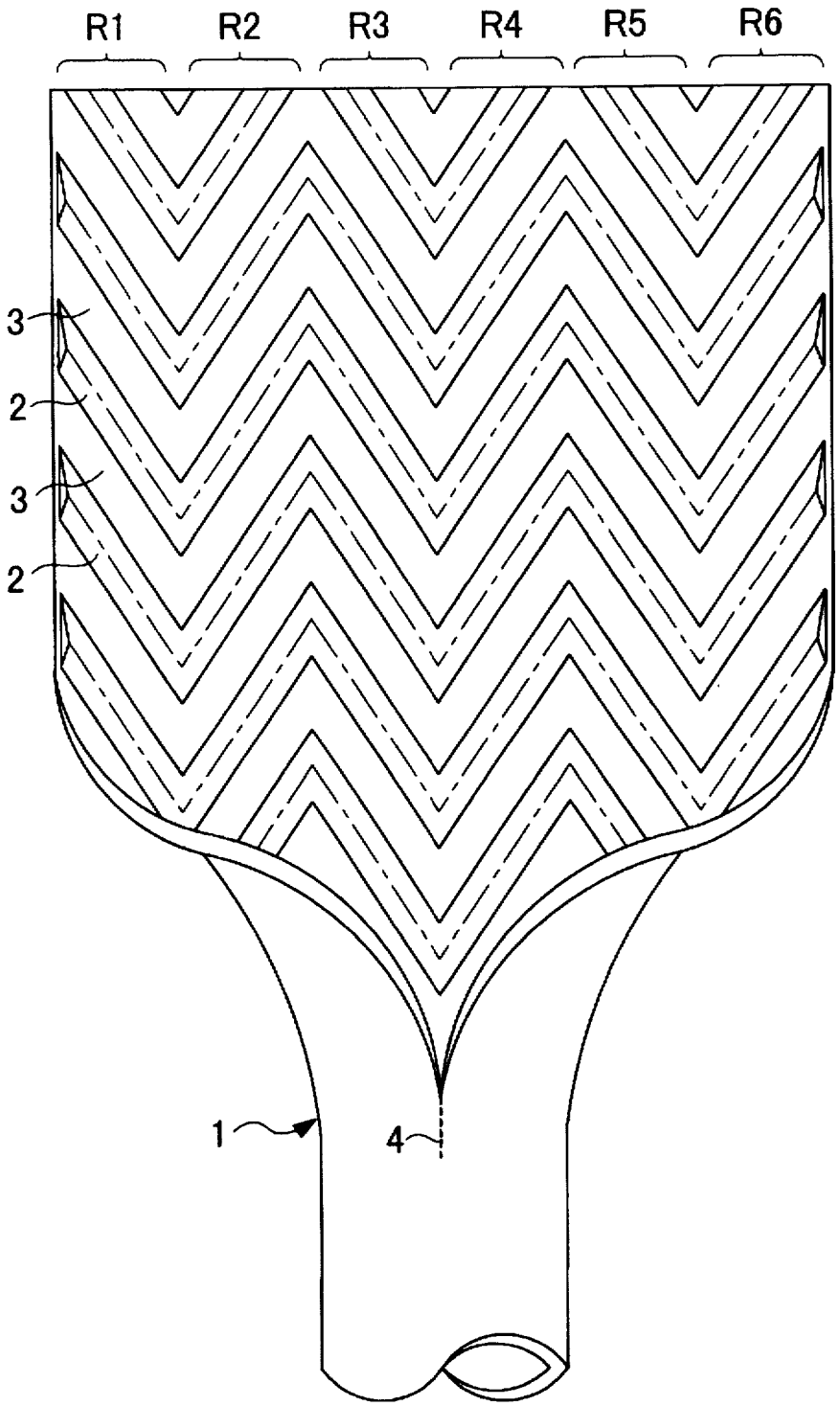
FIG. 4 is a plan view showing another embodiment of the present invention wherein the inner surface of the tube has been partially spread open.

FIG. 4 shows a third embodiment of the present invention. In the present example, the inner surface of the heat transfer tube 1 is divided into six regions R1~R6 in the circumferential direction, with a plurality of mutually parallel fins 2 aligned along an axial direction of the heat transfer tube 1 being formed in each of these regions R1~R6. The other features are identical to Embodiment 1, so they are given the same reference numerals and their explanations are omitted. The remarkable effects of Embodiment 1 are able to be obtained by a grooved-inner-surface heat transfer tube 1 of this type of structure as well.

Of course, the grooved-inner-surface heat transfer tube of the present invention is not necessarily restricted to the structures of the above embodiments, and various other structure are also possible. For example, if the outer diameter of the heat transfer tube is large, the inner surface of the heat transfer tube can be divided into eight or more regions, and the fins can be given arcuate shapes if necessary. Furthermore, concave portions or indentations may be formed at the central portions of the fins 2.

Embodiment 4

Figure 5:
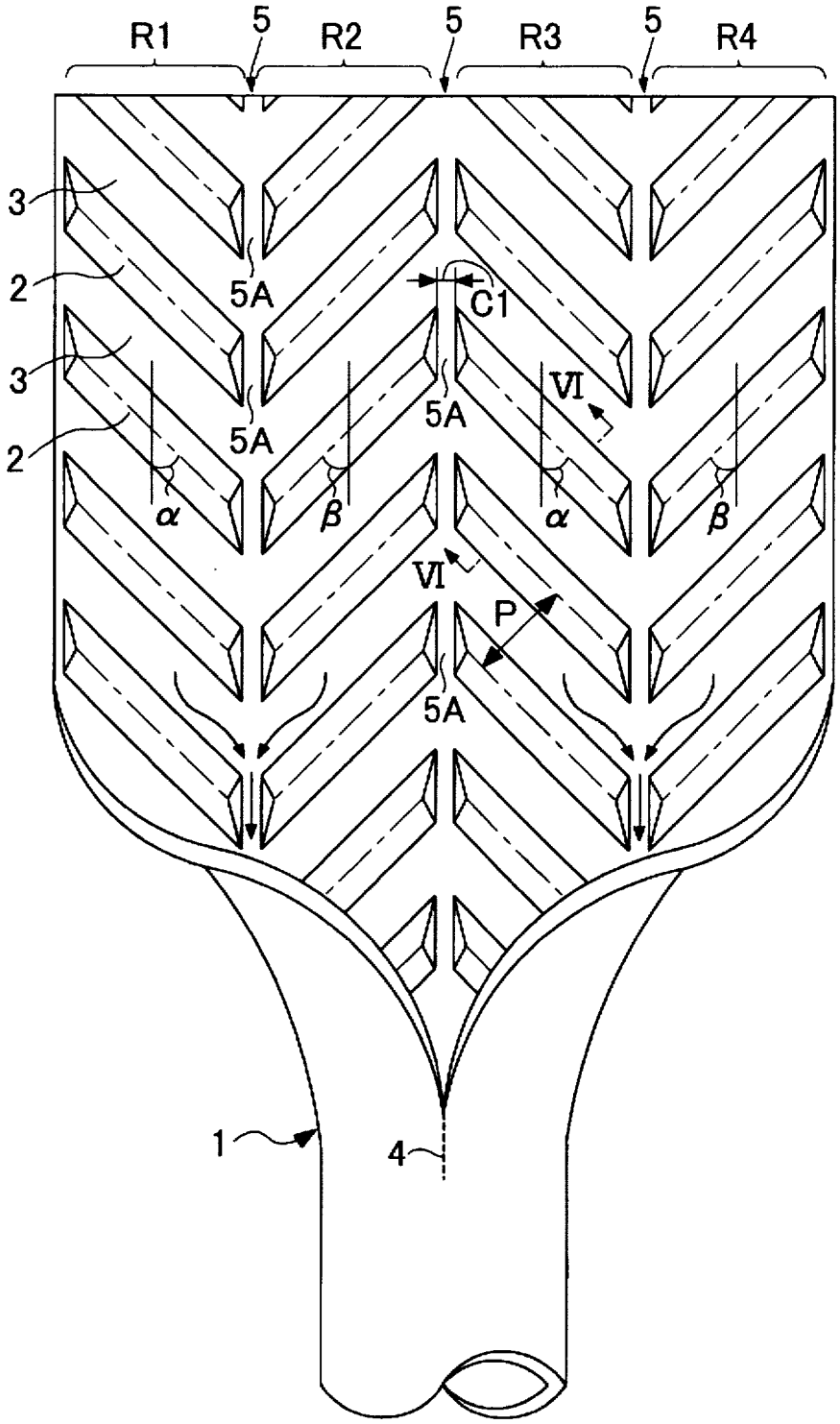
FIG. 5 is a plan view showing another embodiment of the present invention wherein the inner surface of the tube has been partially spread open.

FIG. 5 is a plan view showing another embodiment of the present invention wherein the inner surface of the tube has been partially spread open. The inner circumferential surface of this grooved-inner-surface heat transfer tube 1 is divided into four regions R1~R4 each taking up 90° in the circumferential direction. Each of these regions R1~R4 has a plurality of mutually parallel fins 2 which are aligned in an axial direction of the heat transfer tube 1, and groove portions 3 are formed between the parallel fins 2.

With this grooved-inner-surface heat transfer tube 1, the fins 2 in the odd regions R1 and R3 counting from one of the regions (R1 in this case) are formed so as to make an angle $\alpha$ with respect to the axis of the heat transfer tube, and the fins 2 in the even regions R2 and R4 are formed so as to make an angle $\beta$ with respect to the axis of the heat transfer tube.

The inclination angles $\alpha$ and $\beta$ may have opposite values, and it is only necessary that the fins 2 which lie adjacent each other in the circumferential direction be inclined in mutually opposite direction with respect to the axis of the heat transfer tube, so that the fins 2 are arranged in an overall zigzag pattern. In this embodiment, the tips of adjacent fins 2 are aligned in the circumferential direction. Additionally, while the fins 2 within the same region are mutually parallel in FIG. 5, these are not necessarily parallel, so that the inclination angle can be changed for each fin within the above-mentioned range.

A groove portion 5 which extends in the axial direction of the heat transfer tube 1 is formed at the boundary between each region R1~R4, whereby a constant gap 5A is formed between the fins 2 which are adjacent in the circumferential direction. The bottoms of the groove portions 5 may be given the same height as the bottoms of the groove portions 3, or they may be somewhat higher than the groove potions 3. In a general-purpose heat transfer tube having an outer diameter of approximately 1 cm, the width C1 of the gap 5A should preferably be 0.05~0.5 mm, especially 0.1~0.3 mm. If the width C1 is within the range of 0.05~0.5 mm, the balance between the pressure loss and the heat transfer efficiency is good. However, the present invention is not restricted to only the ranges listed above, and other values may also be used as a matter of course.

While the cross-sectional shape of the fins 2 is not necessarily restricted, they should desirably be similar to those of Embodiment 1. When fins which are taller than is conventional are used in this way, the turbulence generation effect is improved, so as to work together with the effects due to the special arrangement of the fins to markedly increase the heat exchange efficiency of the heat transfer tube 1. Additionally, this type of thin and tall fin 2 gives excellent drainage properties to the end portions of the fins 2 when the inner surface of the metallic tube 1 is covered in heat transfer fluid, so that the metallic surfaces at the ends of the fins 2 more easily contact the heat transfer gas when the tube is used as a condensation tube, thereby resulting in improved condensation performance.

While the angle $\gamma$ (apex angle) formed between the side surfaces of the fins 2 is not necessarily restricted, it should preferably be set to be identical with Embodiment 1. While the tops of the fins 2 have a semicircular cross-section in the examples of the drawings, they may be given trapezoidal cross-sections or triangular cross-sections in the present invention. While the cross-sectional shaped of the heat transfer tube 1 is circular in the present embodiment, the present invention is not necessarily restricted to having a circular cross-section, and may be given an oval cross-section or a flat tube shape depending on the need. Furthermore, the tube can be used effectively as the main body of a heat tube as well.

This type of grooved-inner-surface heat transfer tube can also be produced in the same manner as Embodiment 1. As a milling roller for forming fins 2 onto a metallic board material, a layered roller having a milling roller with spiral grooves for forming the fins and the groove portions 3, and a disc-shaped roller for forming the groove portions 5 stacked reciprocally can be used, in which case the shape of each portion can be arbitrarily set by exchanging the roller forming each layer.

With the grooved-inner-surface heat transfer tube 1 according to the above-mentioned structure, not only can the same effects as Embodiment 1 be obtained, but gaps 5A are formed between the end portions of the fins so that the heat transfer medium is able to flow through these gaps 5A to hold down the pressure loss flowing through the heat transfer tube 1 without depending upon the rate of increase of the heat transfer efficiency. In this way, an important effect offered by the present invention is to allow the two counteracting effects of increasing the heat transfer efficiency and reducing the pressure loss to be obtained simultaneously.

Embodiment 5

Figure 6:
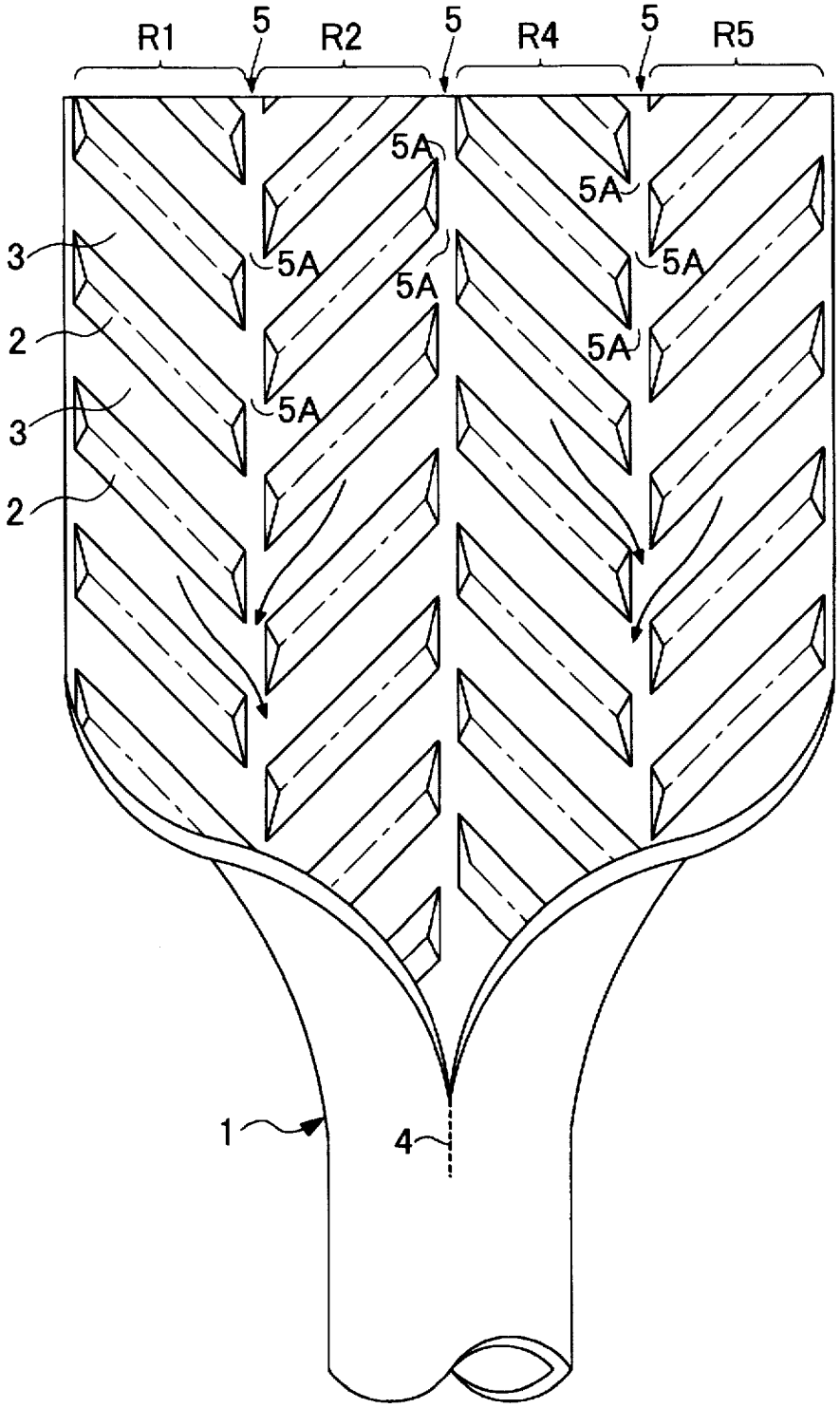
FIG. 6 is a plan view showing another embodiment of the present invention wherein the inner surface of the tube has been partially spread open.

FIG. 6 shows a fifth embodiment of the present invention. While the end portions of the fins 2 lying adjacent in the circumferential direction are aligned in Embodiment 4, Embodiment 5 is characterized in that the fins 2 in adjacent regions are set off by a half-pitch. The other features are identical to those of Embodiment 4.

By setting the fins 2 of the regions R1~R4 off by a half-pitch in this way, the gap 5A between the fins 2 adjacent in the circumferential direction can be substantially enlarged without changing the width of the groove portions 5. Additionally, the tendency for the heat exchange medium to flow in a weaving fashion as indicated by the arrows in the drawings.

Embodiment 6

Figure 7:
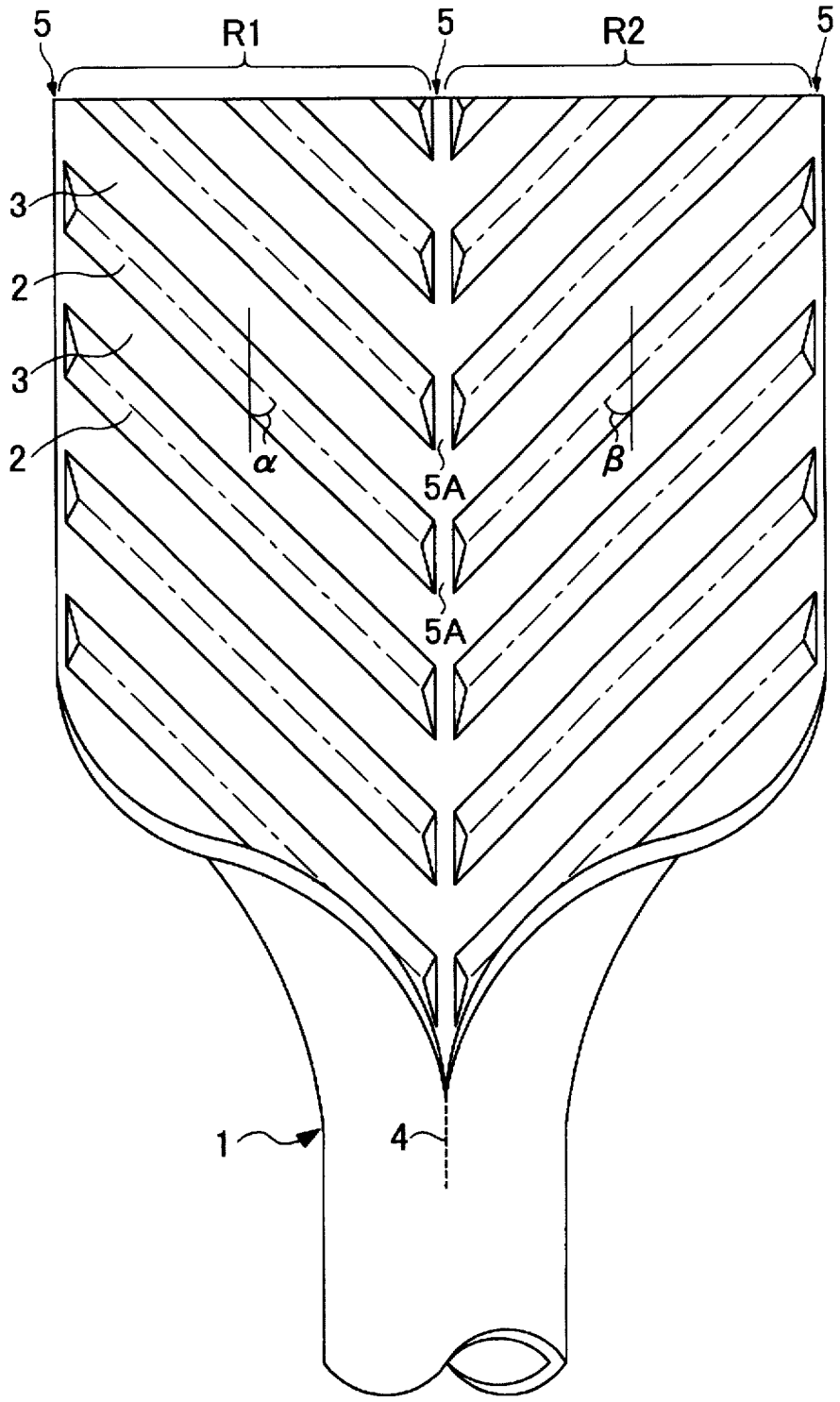
FIG. 7 is a plan view showing another embodiment of the present invention wherein the inner surface of the tube has been partially spread open.

FIG. 7 shows a sixth embodiment of the present invention. While the inner surface of the heat transfer tube 1 is divided into four regions R1~R4 in the fourth embodiment, the inner surface is divided into only two regions R1 and R2 in the circumferential direction in the present example. Consequently, if the outer diameter of the heat transfer tube is the same, then the length of the sins 2 is approximately doubled in comparison the above embodiment. The other features can be made identical to the above-described embodiments.

With Embodiment 6 of this type, the fins 2 formed on the inner surface are arranged so as to form a single V-shape which opens in the upstream direction of flow with respect to a heat transfer medium flowing in either direction, with the heat transfer medium collecting in the groove portion 4 on the side corresponding to the trough of this V-shape. In order to take advantage of this property, the up/down orientation of this heat transfer tube 1 should preferably be set depending on the application, as with the embodiment of FIG. 3. Of course, it is also possible to offset the pitch of the fins in adjacent regions in this embodiment.

Embodiment 7

Figure 8:
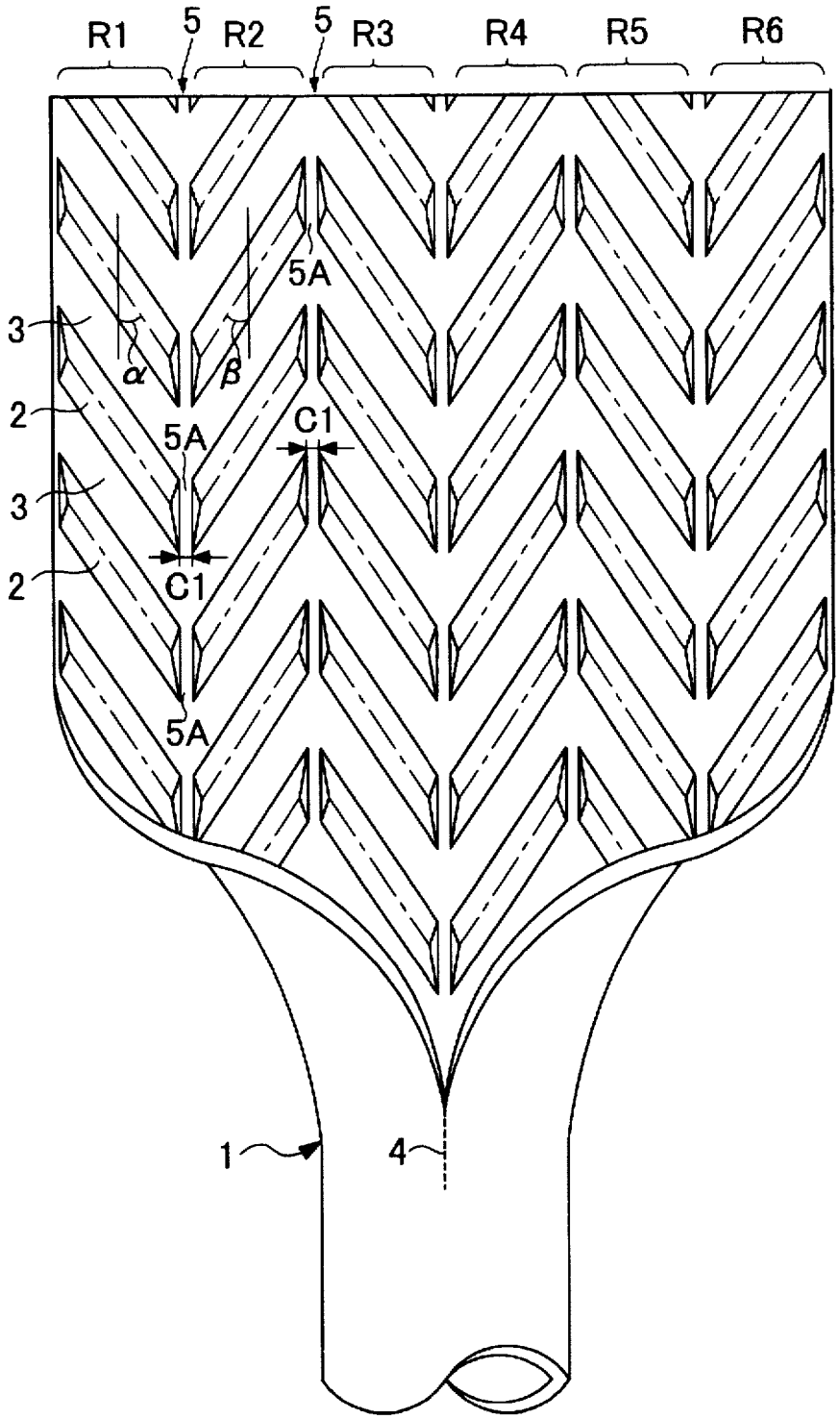
FIG. 8 is a plan view showing another embodiment of the present invention wherein the inner surface of the tube has been partially spread open.

FIG. 8 shows a seventh embodiment of the present invention. This example is characterized in that the inner surface of the heat transfer tube 1 is divided into six regions R1~R6, with a plurality of mutually parallel fins 2 formed along an axial direction of the heat transfer tube 1. The other features are identical to those of Embodiment 4, so they are given the same reference numerals and their explanations are omitted.

The same remarkable effects provided by Embodiment 4 are able to be obtained by the grooved-inner-surface heat transfer tube 1 of this structure as well.

Embodiment 8

Figure 9:
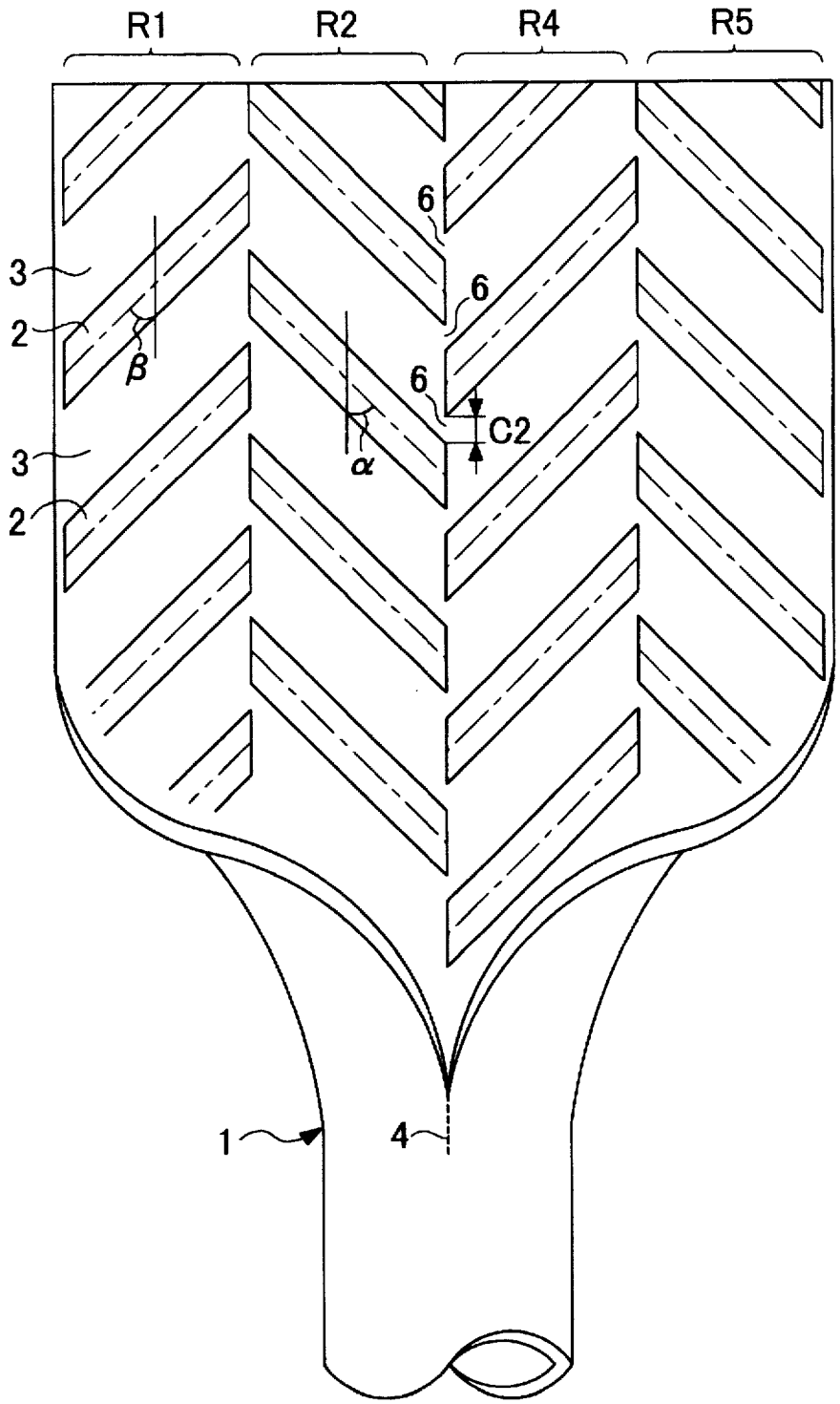
FIG. 9 is a plan view showing another embodiment of the present invention wherein the inner surface of the tube has been partially spread open.

FIG. 9 shows an eighth embodiment of the present invention. This example is similar to Embodiment 4 in that the heat transfer tube 1 is divided into four regions in the circumferential direction, but there is no groove portion 5 formed in the boundaries between the regions; as an alternative, a gap 6 is formed between fins 2 by offsetting the regions R1~R4 by a half-pitch. In a general-purpose heat transfer tube having an outer diameter of approximately 1 cm, the width C1 of the gap 5A should preferably be 0.05~0.5 mm, especially 0.1~0.3 mm. If the width C1 is within the range of 0.05~0.5 mm, the balance between the pressure loss and the heat transfer efficiency is good. However, the present invention is not restricted to only the ranges listed above, and other values may also be used as a matter of course.

According to this type of structure as well, the fins 2 formed on the inner surface of the heat transfer tube are arranged so as to make to pairs of V-shapes (y-shapes) which open in the upstream direction of flow with respect to heat transfer medium flowing in either direction, so that the heat transfer medium collected by the side surfaces of the fins 2 combine at the adjoining portions of the V-shapes, then pass through the gaps 6 between the fins 2. During this process, the heat transfer fluid is agitated to form a chaotic turbulent flow, thus preventing temperature gradients from forming inside the flow of the heat transfer fluid to promote heat transfer between the heat transfer medium and the metallic surfaces of the heat transfer tube, thereby increasing the heat transfer efficiency. Additionally, gaps 6 are formed between the end portions of the fins 2, so that the heat transfer fluid is able to escape by passing through these gaps 6, thereby offering the remarkable effects of holding down the pressure loss in flowing through the heat transfer tube 1 without any regard to the high rate of increase of the heat transfer efficiency.

The grooved-inner-surface heat transfer tubes of the present invention are not necessarily restricted to the embodiments described above, and various other types of structures are also possible. For example, if the outer diameter of the heat transfer tube is large, then the inner surface of the heat transfer tube can be divided into eight or more regions, and the fins can be given arcuate shapes if necessary. Furthermore, concave portions or indentations can also be formed in the central portions of the fins 2.

Embodiment 9

Figure 10:
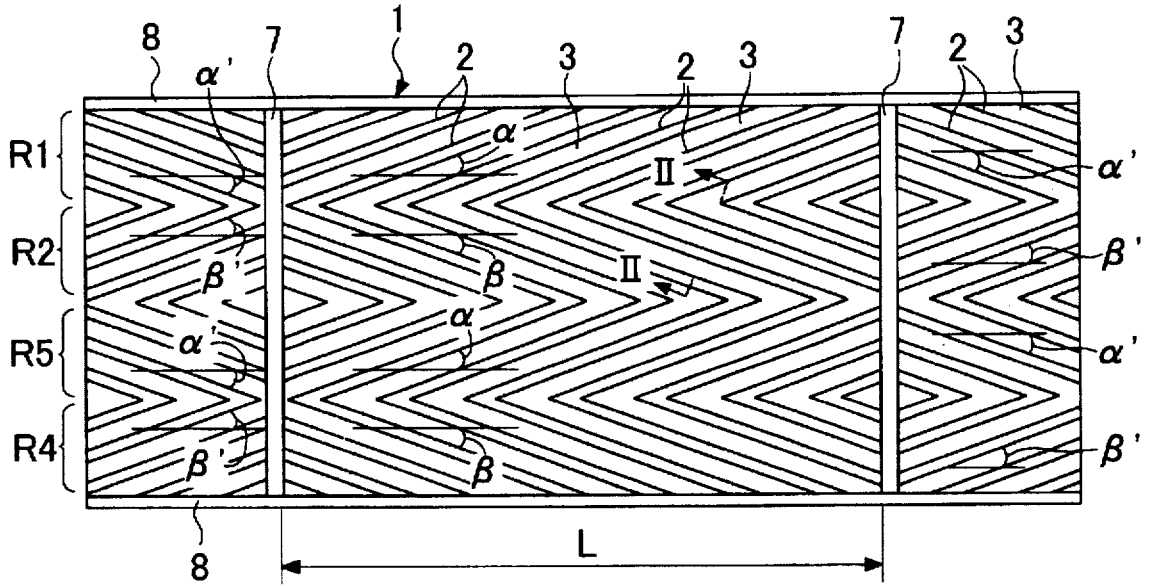
FIG. 10 is a spread-open view showing the inner surface of a tube according to another embodiment of the present invention.

FIG. 10 is a spread-open view showing the inner surface of a tube according to another embodiment of the present invention.

This groove-inner-surface heat transfer tube 1 has a plurality of fins 2 which extend along the circumferential direction in zigzag fashion. These fins 2 are formed so that the orientation of the inclination angles α and β are reversed every designated interval L in the axial direction (α→α'→α→α' . . . , β→β'→β→β' . . . ). The space between adjacent fins 2 is made into a groove portion 3 having a constant width, with a projection 7 having a constant width and extending along the entire circumference of the inner surface is formed at the boundary at which the orientation of the fins 2 changes.

A finless portion 8 having a constant width and extending in an axial direction is formed along the entire length of a portion of the inner surface of this grooved-inner-surface heat transfer tube 1, and a welding line is formed along the entire length at the center of this finless portion 8 (refer to the welding line 4 of FIG. 1). The fins 2 are separated by means of this finless portion 8 and the welding line. The welding line may project inward from the inner surface of the grooved-inner-surface heat transfer tube, but it should project by an amount less than the amount by which the fins 2 project, so that the tube expander plug does not hit the welding line when a tube expander plug is inserted into the grooved-inner-surface heat transfer tube in order to expand the tube.

As shown in FIG. 10, the inner surface of the heat transfer tube 1 of the present embodiment is divided into four regions R1~R4 each taking up 90° in the circumferential direction, with the odd regions R1 and R3 counting from any one of the regions (R1 in this case), and the even regions R2 and R4 have fins 2 which form mutually opposite inclination angles (α and β, α' and β') with the axial line. The absolute values of the inclination angles (α, β, α' and β') should preferably be 10°~25°. If the absolute value of the inclination angle exceeds 25°, the fins 2 come close to being perpendicular to the flow so that the flow is obstructed and the pressure loss becomes large.

Additionally, if the absolute value of the inclination angle becomes less than 10°, the fins 2 become close to being parallel to the flow so that the turbulence generation effect due to the fins 2 is reduced.

While the absolute values of the inclination angles α and β and the absolute values of the inclination angles α' and β' can be made mutually equal, they may be made different as long as they are within the above-mentioned range. Likewise, while the absolute values of the inclination angles α and α' and the absolute values of the inclination angles β and β' can be made equal, they may be made different as long as they are within the above-mentioned range. Additionally, while the fins 2 in the same region can be made parallel in Embodiment 10, they are not necessarily restricted to being parallel, so that the inclination angle can be made to change for each fin, as long as they are within the above-mentioned range.

While the interval L of the angle reversal of the fins 2 is not necessarily restricted, it should preferably be 100~500 mm, and more preferably 200~400 mm. Within the range of 100~500 mm, the agitation effect for the heat transfer medium due to the fins 2 is adequately activated, so that non-uniformities in the heat transfer medium can be corrected by the fins 2 to improve the balance therebetween.

Figure 11:
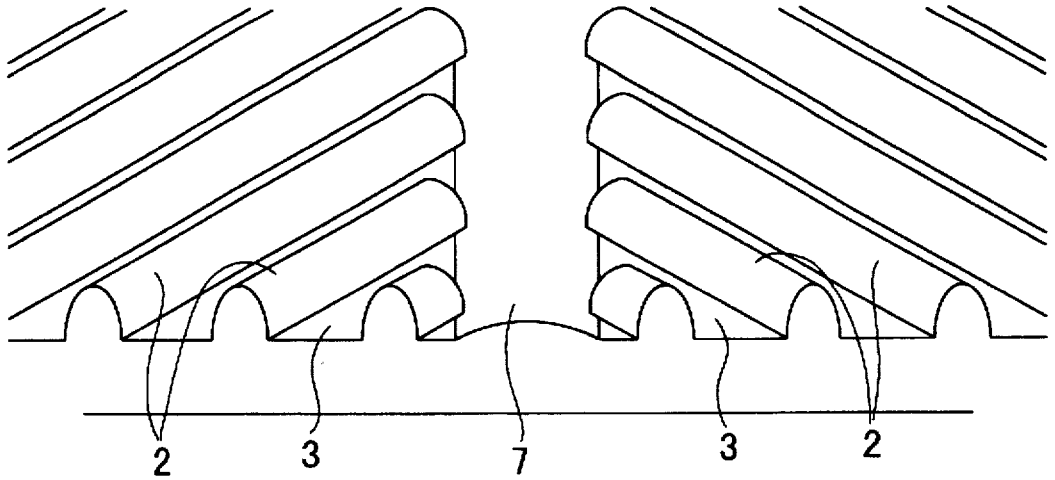
FIG. 11 is an enlarged perspective view showing the fin boundary portion of the embodiment shown in FIG. 10.

The projection 7 has a slightly curved cross-section and has a maximum amount of projection smaller than the fins 2, as shown in FIG. 11. By forming the projections 7 in this way, the average thickness of the grooved-inner-surface heat transfer tube 1 at the reversal boundary of the fins 2 can be made approximately equal to that of other portions, so as to prevent decreases in the strength at the boundary portion of the fins 2.

Figure 12:
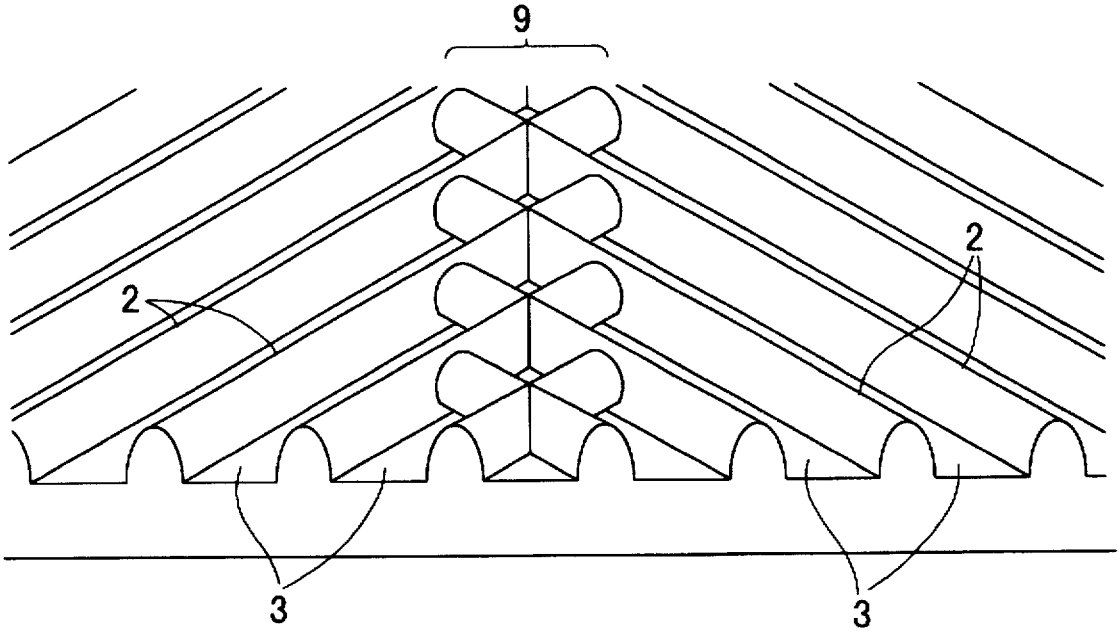
FIG. 12 is an enlarged perspective view showing a modification example of the fin boundary portion.
Figure 13:
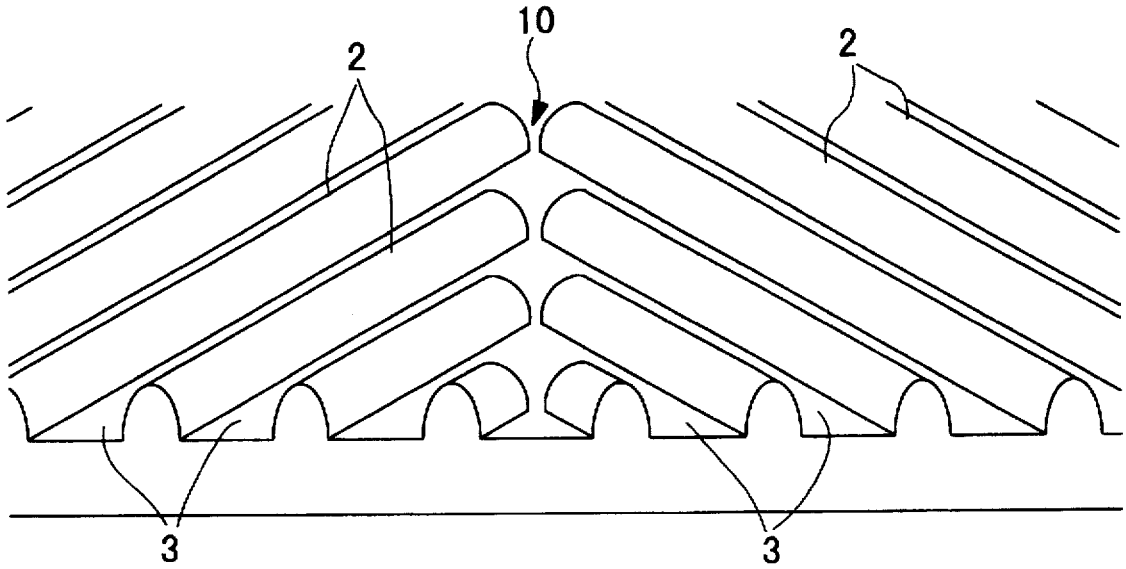
FIG. 13 is an enlarged perspective view showing a modification example of the fin boundary portion.
Figure 14:
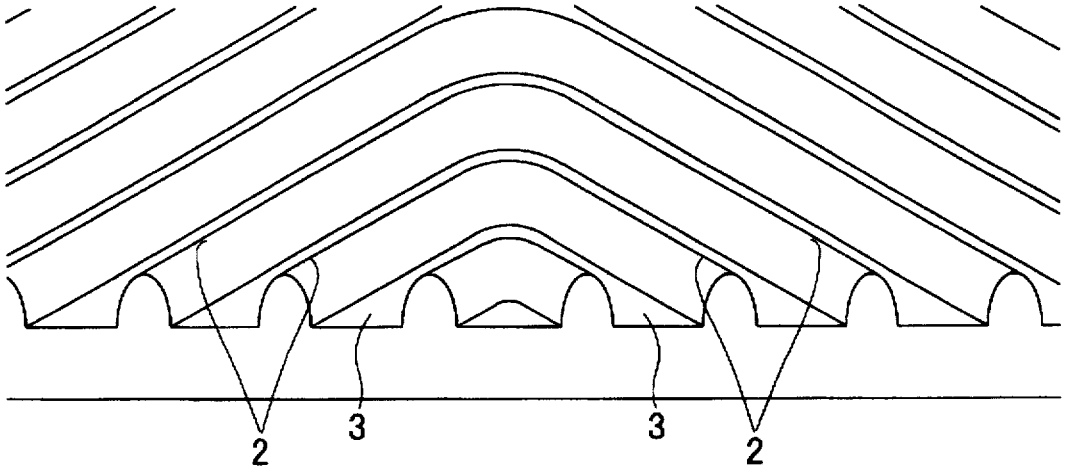
FIG. 14 is an enlarged perspective view showing a modification example of the fin boundary portion.

On the other hand, a projection 7 does not necessarily have to be formed at the boundary portion of the fins 2 as shown in FIG. 11, so that an intersection portion 9 having a constant width can be formed by overlapping the fins 2 by a designated length as shown in FIG. 12, an adjoining portion 10 can be formed by adjoining the end portions of the fins 2 as shown in FIG. 13, or the fins 2 can be made continuous as shown in FIG. 14. In any of these cases, it is possible to prevent decreases in the anti-deformation strength at the boundary portion of the fins 2.

As explained with reference to FIG. 2, the cross-sectional shape of the fins 2 is such that the pitch P between fins 2 in the same region is preferably 0.3~0.45 mm, and more preferably 0.33~0.38 mm; while the height H of the fins 2 from the inner surface of the metallic tube is preferably 0.15~0.30 mm, and more preferably 0.22~0.26 mm. When the fins are made taller than in conventional products in this manner, the turbulence generation effect is improved, so as to work together with the effect given by the zigzag arrangement of the fins 2 to increase the heat transfer effect of the heat transfer tube 1. Additionally, these types of thin and tall fins 2 improve the drainage at the tips of the fins 2 when the inner surface of the metallic tube 1 is covered with heat transfer fluid, so that the metallic surfaces at the tips of the fins 2 easily make direct contact with the heat transfer gas when it is used as a condensation tube, thereby resulting in excellent condensation performance.

The angle γ (apex angle) formed between the side surfaces of the fins 2 should preferably be 10°~25°, and more preferably 15°~20°. The reason is the same as that for Embodiment 1.

With the grooved-inner-surface heat transfer tube 1 according to the above-mentioned embodiment, the direction of advancement of the heat transfer medium which flows inside the grooved-inner-surface heat transfer tube 1 is slanted along the fins 2, so that the heat transfer medium is agitated by this process to promote heat exchange between the grooved-inner-surface heat transfer tube 1 and the heat transfer medium. Even if the heat transfer medium becomes concentrated at a certain location in the groove-inner-surface heat transfer tube 1 during this agitation process, the direction of advancement of the heat transfer medium is again slanted by the fins 2 at the next region wherein the inclination angle of the fins 2 has been reversed, so that the agitation of the heat transfer medium is made more complete. In this way, it is possible to increase the heat transfer efficiency by forcibly changing the direction of flow of the heat transfer medium to perform an agitation after each constant interval L.

Specifically, the fins 2 formed on the inner surface of the grooved-inner-surface heat transfer tube 1 are arranged so as to form two pairs of V-shapes which open on the upstream end of the flow of the heat transfer medium, so that the heat transfer medium is combined at the adjoining portions of the V-shapes and flows over and past these adjoining portions. Since this process generates chaotic turbulent flow by agitating the heat transfer medium, the agitation effects work together with the above-mentioned effects to increase further, thereby allowing temperature gradients to be prevented from forming in the flow of the heat transfer medium, and promoting heat exchange between the heat transfer medium and the metallic surfaces in order to allow the heat transfer efficiency to be increased.

Embodiment 10

Figure 15:
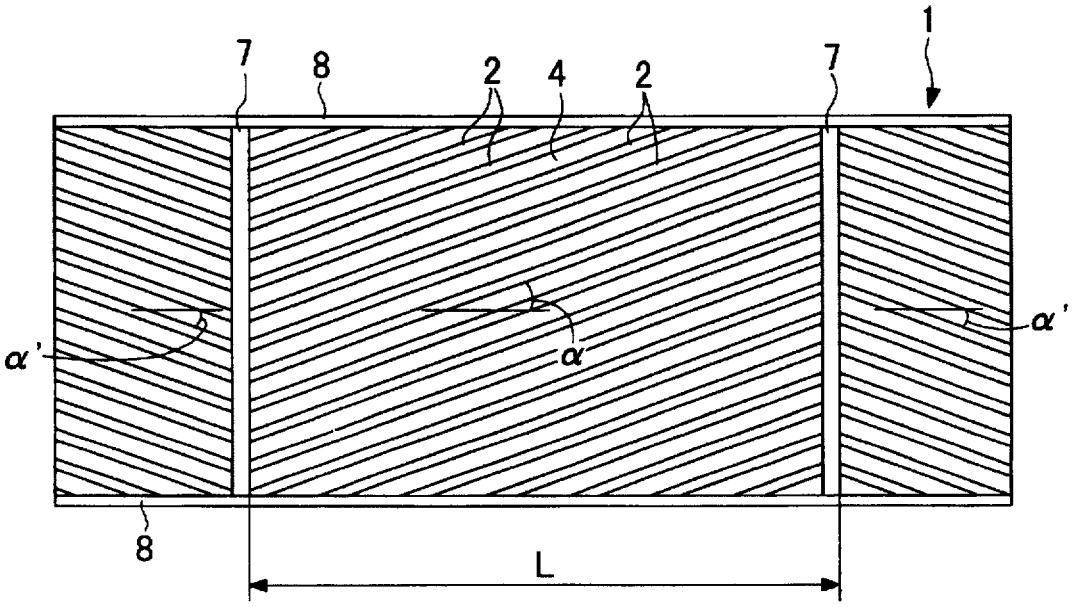
FIG. 15 is a spread-open view showing the inner surface of a tube according to another embodiment.

FIG. 15 is a spread-open view showing the inner surface of a tube according to another embodiment. The present embodiment is identical to Embodiment 9, with the exception that the fins 2 do not bend in zigzag fashion and form a simple spiral pattern.

With a grooved-inner-surface heat transfer tube 1 of this type, the heat transfer medium flowing through the tube is reciprocally turned to the opposite direction by means of the spiral fins 2 which reverse at each constant interval L, so as to be different from heat transfer tubes having simple spiral fins in that the heat transfer medium does not flow collectively in specific areas, thereby obtaining an exceptional agitation effect. As a result, the heat transfer efficiency is able to be increased.

Embodiment 11

Figure 16:
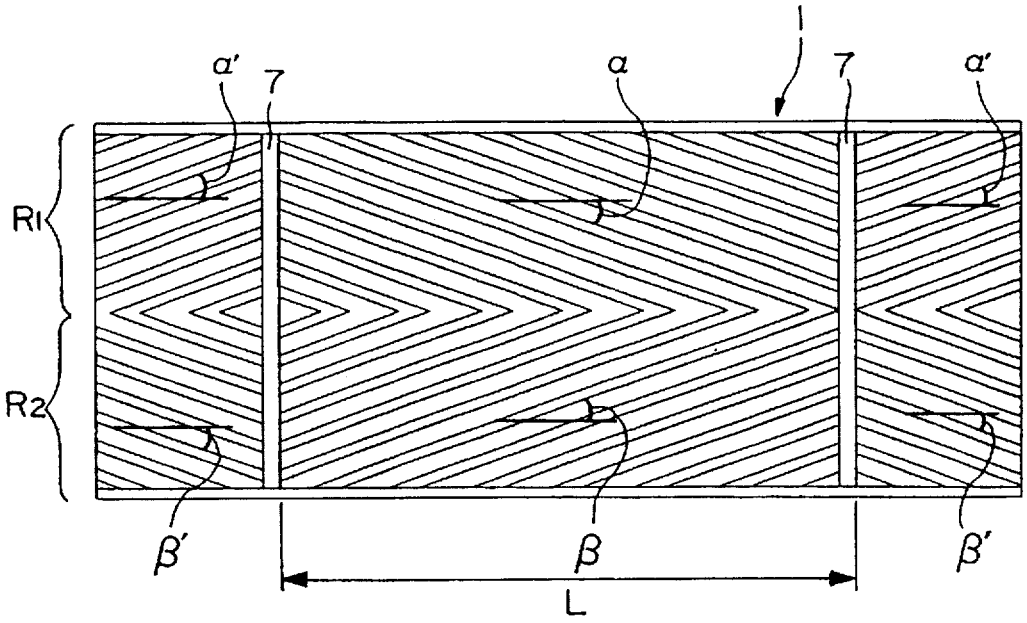
FIG. 16 is a spread-open view showing the inner surface of a tube according to another embodiment.

FIG. 16 is a spread-open view showing the inner surface of a grooved-inner-surface heat transfer tube according to an eleventh embodiment of the present invention. The present embodiment differs from Embodiment 9 in that the fins 2 are formed into a V-shape. That is, in the present embodiment, the inner surface of the tube is divided into two regions R1 and R2 in the circumferential direction, with the angles $\alpha$ and $\beta$ between the axis and the fins 2 having mutually opposite orientations between the regions R1 and R2. Additionally, the orientations of the inclination angles $\alpha$ and $\beta$ within each region R1 and R2 are reversed for each standard interval L in the axial direction of the tube ($\alpha \rightarrow \alpha' \rightarrow \alpha \rightarrow \alpha' \ldots, \beta \rightarrow \beta' \rightarrow \beta \rightarrow \beta' \ldots$). The other features are identical to those of Embodiment 9.

According to a grooved-inner-surface heat transfer tube 1 of this type, the heat transfer medium flowing within the tube has a tendency to concentrate toward the trough portions of the V-shaped fins 2, so that the heat transfer fluid combines at the trough portion of the V-shape. Since the orientation of the fins 2 then reverses, the heat transfer fluid is separated to the left and right to collect once again at a trough portion at a position on the opposite side with respect to the circumferential direction. By repeating this cycle for each constant interval L, the heat transfer efficiency between the heat transfer medium and the grooved-inner-surface heat transfer tube 1 is increased, thereby allowing an improved heat transfer performance to be obtained.

Embodiment 12

Figure 17:
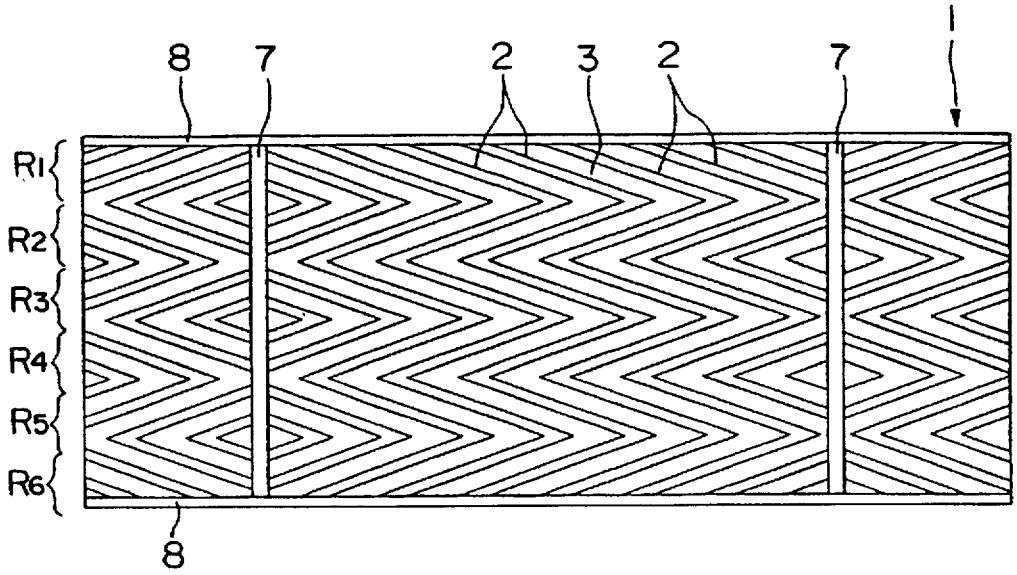
FIG. 17 is a spread-open view showing the inner surface of a tube according to another embodiment.

FIG. 17 is a spread-open view showing the inner surface of a grooved-inner-surface heat transfer tube 1 according to a twelfth embodiment of the present invention. This embodiment differs from Embodiment 9 in that the spread-open shape of the fins 2 has six bends along the circumferential direction to form a "VVV" pattern. That is, in the present embodiment, the inner surface of the tube is divided into six regions R1~R6, with the angles $\alpha$ and $\beta$ between the fins 2 and the axis being reciprocally reversed between these six regions R1~R6. Additionally, the inclination angles $\alpha$ and $\beta$ within each region R1 and R2 are formed so as to reverse their orientation every constant interval L along the axial direction of the tube $\alpha \rightarrow \alpha' \rightarrow \alpha \rightarrow \alpha' \ldots, \beta \rightarrow \beta' \rightarrow \beta \rightarrow \beta' \ldots$). The other features are identical to those of Embodiment 9. The same effects as with Embodiment 9 can be obtained with this type of grooved-inner-surface heat transfer tube 1.

If the number of regions of division becomes numerous, then the fluid resistance due to the fins 2 becomes too large, so that if the outer diameter of the heat transfer tube 1 is 10 mm or less, then there should preferably be 2~6 divisions. Additionally, the number of divisions is not necessarily restricted to even numbers, so that the effects are not much influenced by odd numbers of divisions.

Embodiment 13

Figure 18:
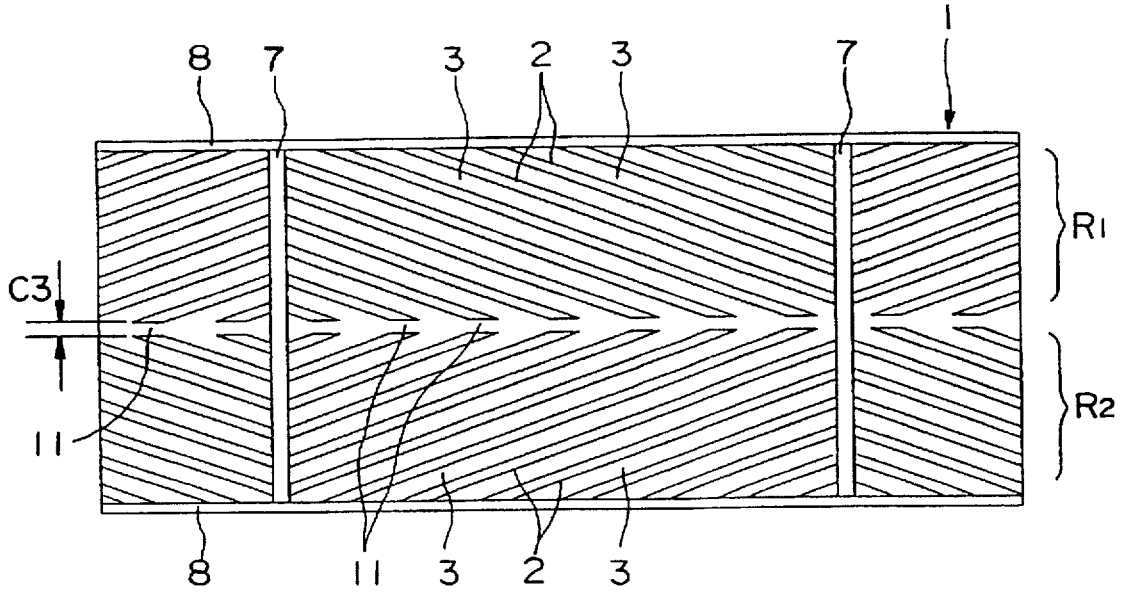
FIG. 18 is a spread-open view showing the inner surface of a tube according to another embodiment.

FIG. 18 is a spread-open view showing the inner surface of a grooved-inner-surface heat transfer tube according to a thirteenth embodiment of the present invention. In the present embodiment, a gap 11 is formed at the central portion of the V-shaped fins 2 shown in FIG. 16. That is, this grooved-inner-surface heat transfer tube 1 has two slanted fins 2 along the circumferential direction of the inner surface of the tube, arranged with a space formed therebetween. The inclination angles and other features are identical to those of the embodiment of FIG. 16.

While the width C3 of the gap 11 is not especially restricted, the width should preferably be 0.05 mm~0.5 mm in a normal heat transfer tube with an outer diameter of approximately 10 mm. Within this range, an excellent heat transfer performance can be obtained while markedly reducing the fluid resistance of the heat transfer medium. The effect of reducing the fluid resistance is excellent if the depth of the gap 11 is made equal to that of the groove portions 3, but the depth of the gap can be made shallower than the groove portions 3 depending upon the situation.

With Embodiment 13 according to this type of structure, the heat transfer medium collected by the side surfaces of the fins 2 is combined at the adjoining portion of the V-shapes, then passes through the gap 11, by which process the heat transfer medium is agitated. Consequently, the pressure loss of the heat transfer medium flowing within the heat transfer tube 1 is held low almost without any degradation of the heat transfer medium agitation effect due to the fins 2. An important effect offered by the present invention is to be able to provide the two counteracting effects of increased heat transfer efficiency and reduced pressure loss in this manner. Of course, in this embodiment as well, the flow of the heat transfer medium can be alternately scattered and concentrated because the inclination angle of the fins 2 reverses upon every constant interval L in the axial direction of the tube.

Embodiment 14

Figure 19:
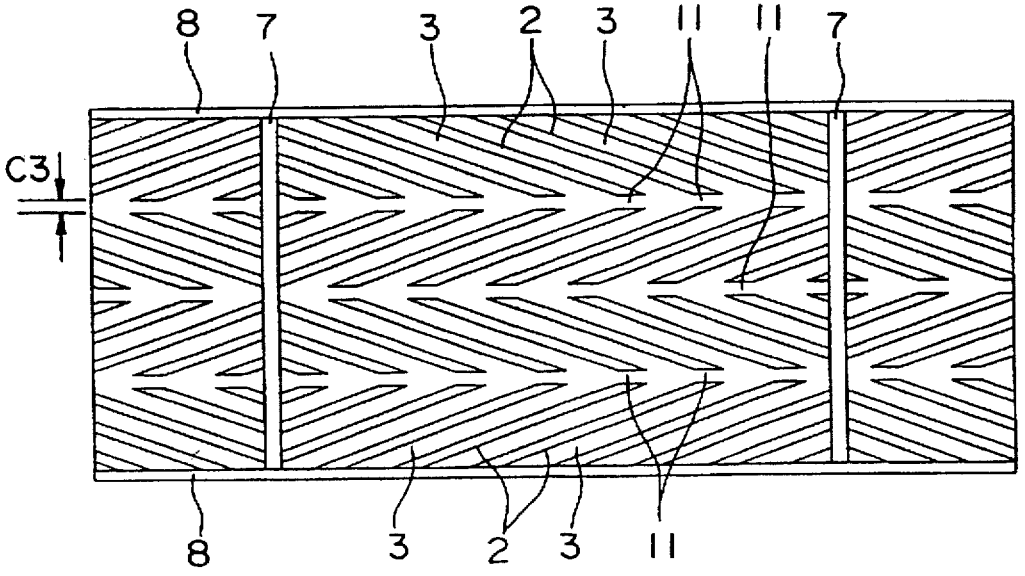
FIG. 19 is a spread-open view showing the inner surface of a tube according to another embodiment.

FIG. 19 is a spread-open view of the inner surface of a fourteenth embodiment of a grooved-inner-surface heat transfer tube 1 according to the present invention. The present embodiment is characterized in that gaps 11 are formed at the bending points of the W-shaped fins 2 shown in FIG. 10. According to this embodiment, the fluid resistance of the heat transfer medium is able to be reduced by means of the gaps 11 while holding down the pressure loss in the heat transfer medium flowing inside the heat transfer tube 1, without degrading the effects of Embodiment 10.

Embodiment 15

Figure 20:
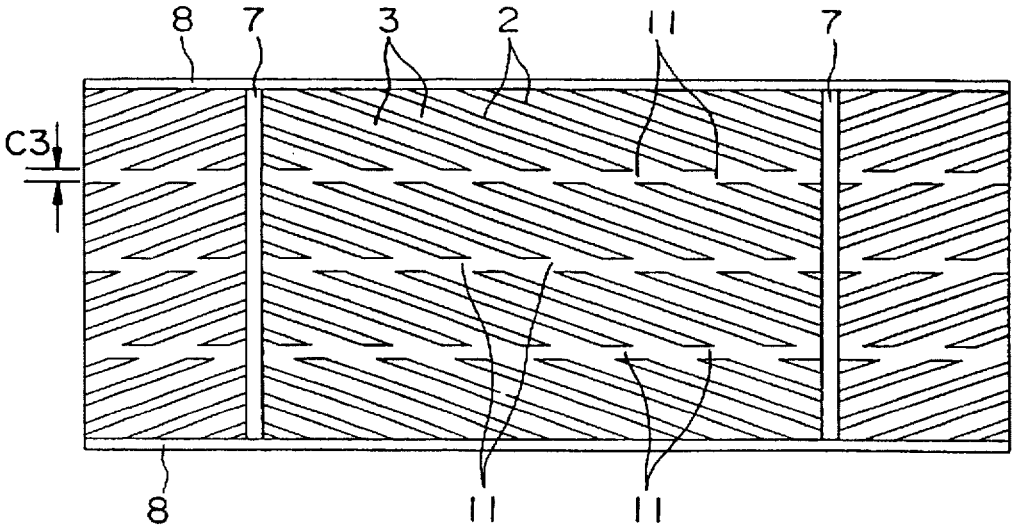
FIG. 20 is a spread-open view showing the inner surface of a tube according to another embodiment.

FIG. 20 is a spread-open view of the inner surface of a fifteenth embodiment of a grooved-inner-surface heat transfer tube according to the present invention. The present embodiment is characterized in that gaps 20 are formed at constant intervals along the longitudinal direction of the spiral fins 2 shown in FIG. 15. In this case also, the pressure loss in the transfer medium flowing in the heat transfer tube 1 can be held low by suitably allowing heat transfer medium to escape by means of the gaps 20, while maintaining the effects provided by the embodiment of FIG. 15.

Embodiment 16

Figure 21:
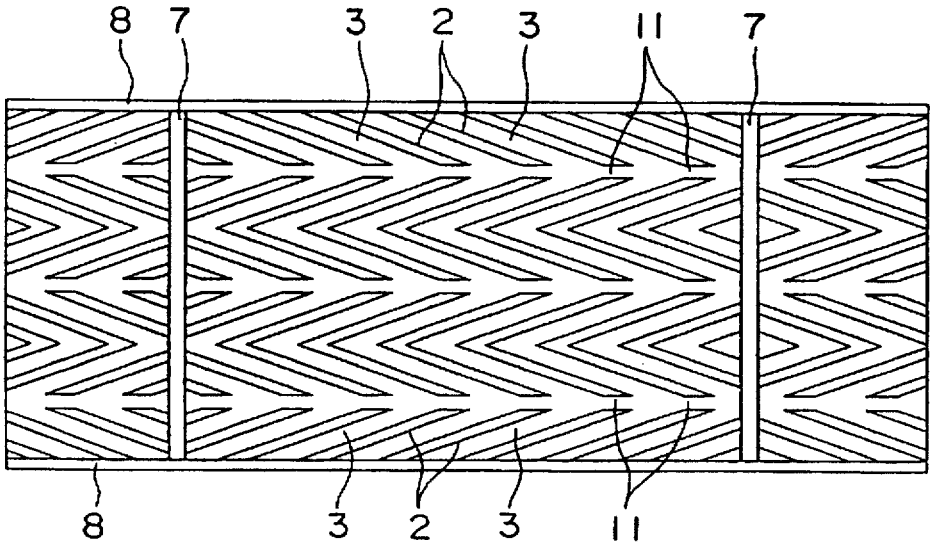
FIG. 21 is a spread-open view showing the inner surface of a tube according to another embodiment.

FIG. 21 is a spread-open view showing the inner surface of a sixteenth embodiment of a grooved-inner-surface heat transfer tube according to the present invention. The present embodiment is characterized in that gaps 11 are formed at every other bending point in the "VVV"-shaped fins 2 shown in FIG. 17. In this case as well, the pressure loss in the transfer medium flowing in the heat transfer tube 1 can be held low by suitably allowing heat transfer medium to escape by means of the gaps 20, while maintaining the effects provided by the embodiment of FIG. 17.

Embodiment 17

Figure 22:
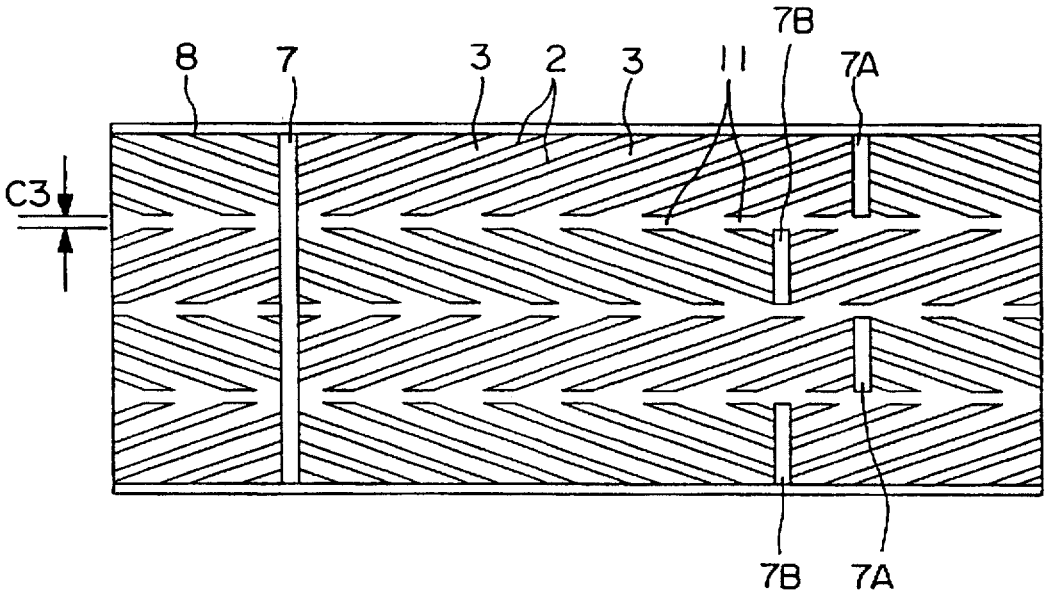
FIG. 22 is a spread-open view showing the inner surface of a tube according to another embodiment.

FIG. 22 is a spread-open view showing a seventeenth embodiment of the present invention. The present embodiment is characterized in that the interval by which the direction of inclination of the fins 2 reverses is made different for each region. That is, the positions of the projections 7A and 7B formed at the reversal boundaries are mutually offset along the axial direction of the tube. In this case also, the shape of the boundary portion may be any of the structures shown in FIGS. 11, 12, 13 and 14.

The grooved-inner-surface heat transfer tube of the present invention is not necessarily restricted to the embodiments mentioned above, and various other types of structures are possible. For example, if the outer diameter of the heat transfer tube is large, then the inner surface of the heat transfer tube can be divided into seven or more regions, or it is possible to form the fins 2 so as to form arcs instead of lines when the tube is spread open if necessary. Furthermore, it is possible to add changes such as to offset only the fins in even or odd regions by a half-pitch in the axial direction of the tube, or to form concave portions or indentations at suitable locations in the fins 2.

Embodiment 18

Figure 32:
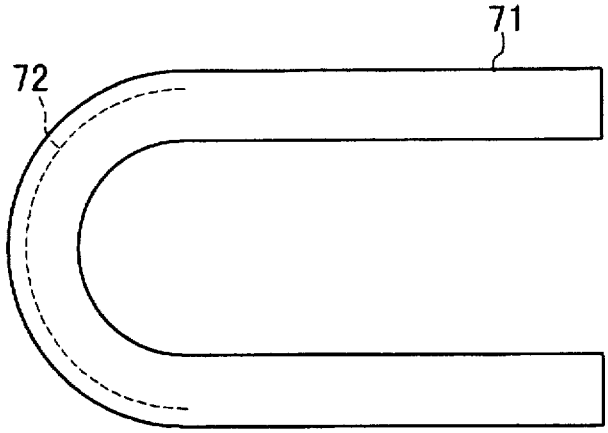
FIG. 32 is a plan view showing a problem solved by the embodiment shown in FIG. 23.

Upon producing a grooved-inner-surface heat transfer tube having a zigzag pattern as shown in FIG. 1, the inventors discovered that when this grooved-inner-surface heat transfer tube is rounded into a U-shape, bumps 72 form along the dotted line in FIG. 32.

Figure 33:
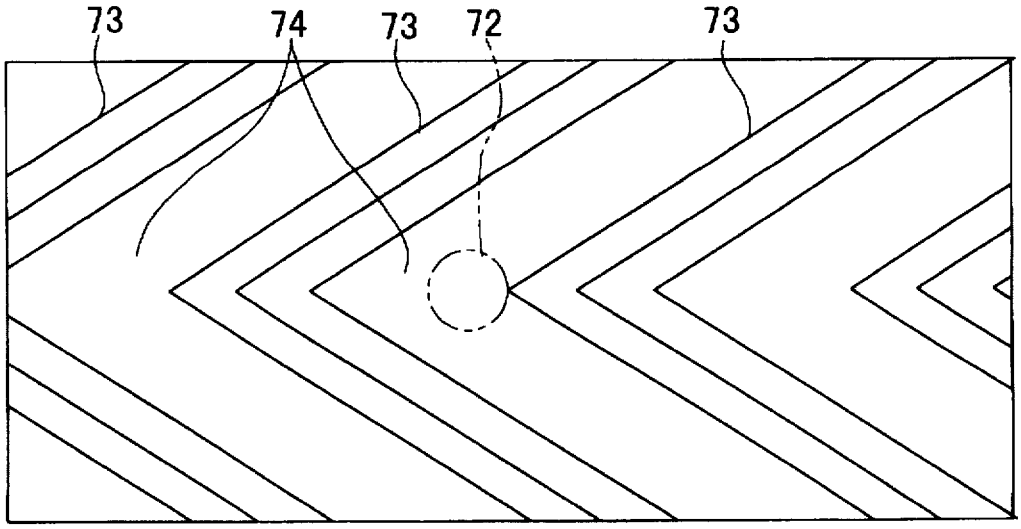
FIG. 33 is an enlarged view of the inner surface of a tube showing a problem solved by the embodiment shown in FIG. 23.

As a result of a detailed inspection of this phenomenon, it was observed that the bumps 72 are formed because the fins 73 are very hard in comparison to the thin groove portions 74 between the fins as shown in FIG. 33, so that the hardness at the tips of the bent portions of the zigzag-shaped fins 73 causes the thin portions 74 adjacent to these tip portions to be locally stretched during the rounding process. Since these bumps 72 make the thin portions 74 even thinner, not only do they degrade the outward appearance, but they are also undesirable if the reliability of the heat transfer tubes is a consideration.

The following embodiments have the object of resolving these problems.

Figure 23:
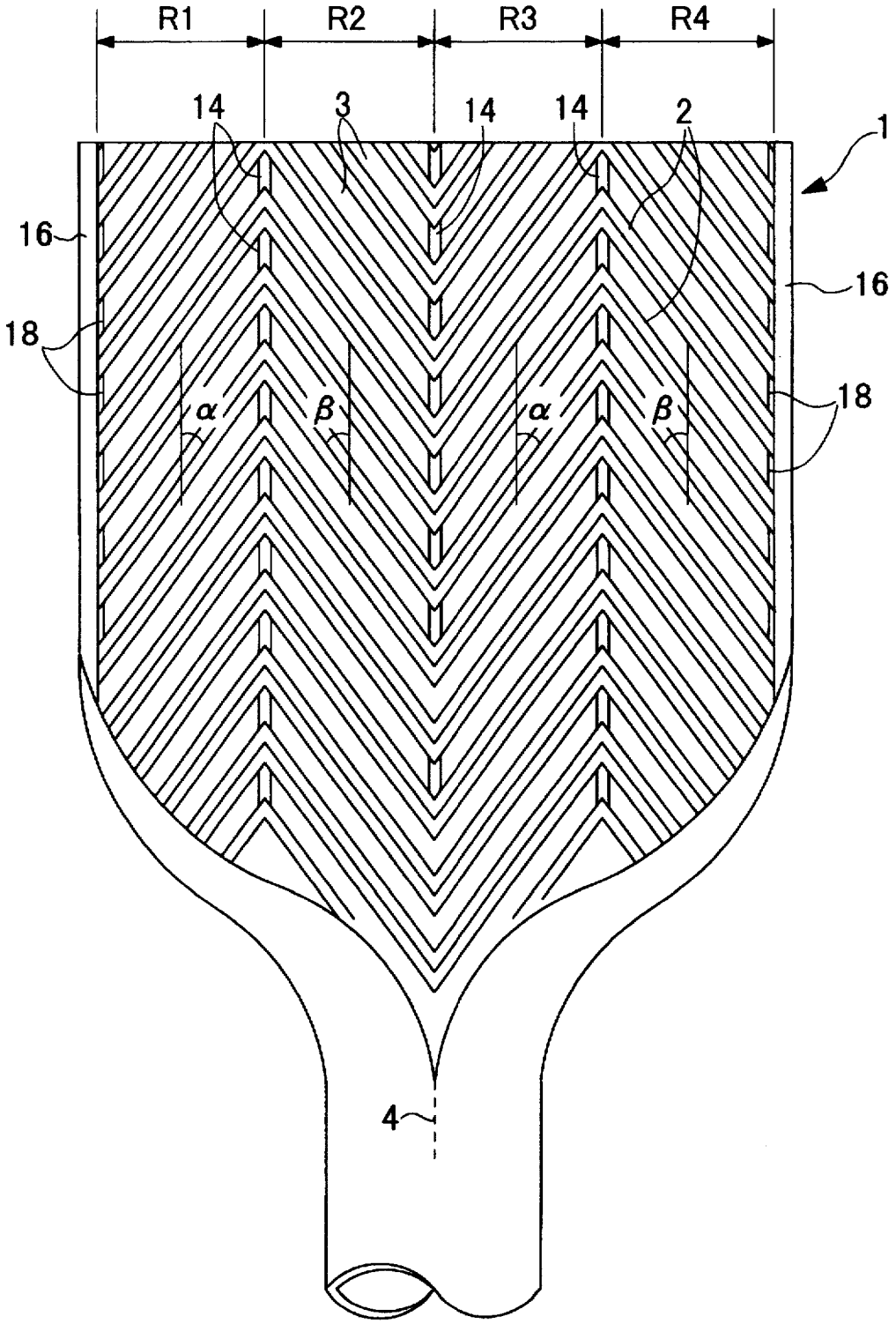
FIG. 23 is a plan view of another embodiment of the present invention wherein the inner surface of the tube has been partially spread open.

FIG. 23 is a partially spread-open plan view showing an eighteenth embodiment of a grooved-inner-surface heat transfer tube according to the present invention. The inner surface of this grooved-inner-surface heat transfer tube 1 has a plurality of parallel fins 2 extending in zigzag fashion with respect to he circumferential direction, with groove portions 3 formed between the fins 2. Additionally, the inner surface of the grooved-inner-surface heat transfer tube 1 has a single weld line 4 formed so as to project inward along the entire length in the axial direction of the tube. The fins 2 are separated by this weld line 4. This weld line 4 should preferably project by an amount less than the amount by which the fins 2 project.

The inner surface of the grooved-inner-surface heat transfer tube 1 is divided into four regions R1~R4 each of which take up 90° of the circumferential direction. As with Embodiment 1, the odd regions R1 and R3 counting from one of the regions (R1 in this case) have fins 2 formed so as to make a positive angle a with respect to the axis of the heat transfer tube, while the even regions R2 and R4 have fins 2 formed so as to make a negative angle β with respect to the axis of the heat transfer tube. The orientations of the inclination angles α and β may be reversed, as long as the fins 2 incline in reciprocally opposite angles with respect to the axis of the heat transfer tube for every designated length so that the fins 2 form an overall zigzag pattern. While the fins 2 of the same region are mutually parallel in the example shown in the drawing, these do not necessarily have to be parallel, so that the inclination angle can be changed by the fin 2 within the above-mentioned range of angles. Additionally, the widths of the regions R1~R4 are not necessarily restricted to being equal, so that they may be different from each other.

Figure 24:
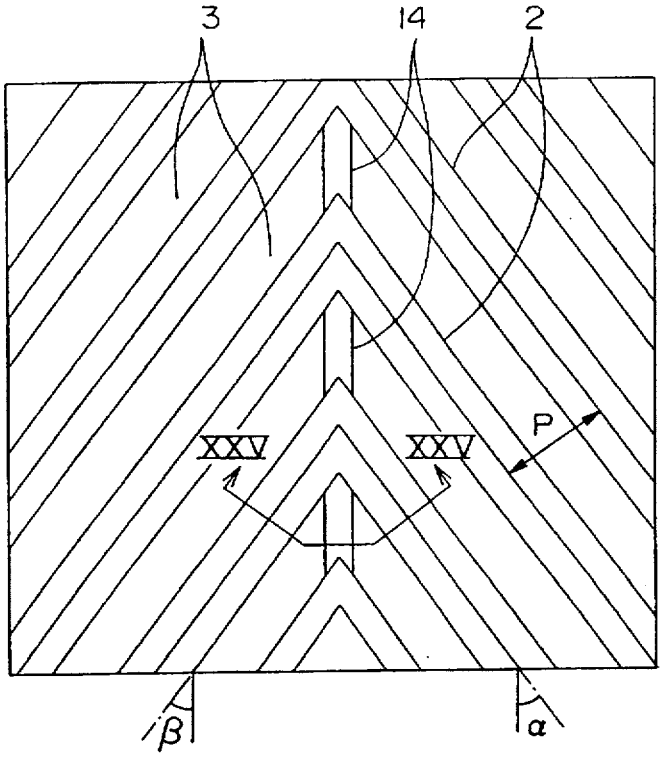
FIG. 24 is an enlarged view of the inner surface of the tube according to the embodiment shown in FIG. 23.
Figure 25:
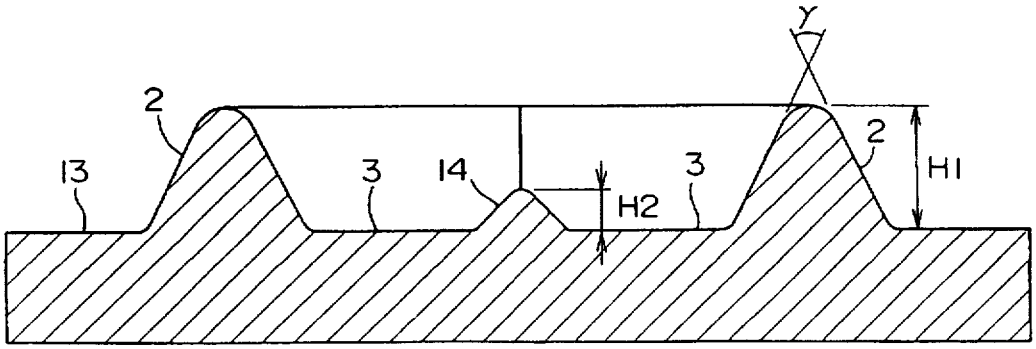
FIG. 25 is a section view cut along the line XXV—XXV in FIG. 24.

The principal feature of the present embodiment is that straight ribs 14 which couple the bending points of adjacent fins in the axial direction of the heat transfer tube are formed along the boundary between each region R1~R4. These ribs 14 are formed unitarily with respect to the inner surface of the grooved-inner-surface heat transfer tube 1 and the fins 2 as shown in FIGS. 24 and 25. The cross-sectional shapes of the ribs are approximately triangular or semicircular. The boundary between the ribs 14 and the inner surface of the grooved-inner-surface heat transfer tube 1 should preferably be chamfered in order to prevent stress from building. While the ribs 14 are formed along the entire length of the grooved-inner-surface heat transfer tube 1 in the present embodiment, they may be formed only at portions of the grooved-inner-surface heat transfer tube 1 which are rounded.

On the inner surface of the grooved-inner-surface heat transfer tube 1, grooveless portions 16 having constant widths extending parallel to the weld line 4 are formed on both sides of the weld line 4 as shown in FIG. 23. Additionally, ribs 18 for coupling the end portions of the fins 2 are formed on the boundaries between the grooveless portions 16 and the end portions of the fins 2. The grooveless portions 16 are necessary in order to make the density of the welding current generated at the end surfaces of the board material uniform when the board material is made into a tube by electrical seam welding. The ribs 18 prevent the grooved-inner-surface heat transfer tube 1 from thinning at the portions corresponding to the end portions of the fins 2, and also function to retain the cross-sectional shape of the grooveless portions 16 when the fins 2 are milled.

The height H2 of the ribs 14 from the inner surface should be lower than the height H1 of the fins 2 from the inner surface, preferably 5~90%, and more preferably 10~70%. If the ribs 14 are taller than the fins 2, then the grooved-inner-surface heat transfer tube 1 cannot be uniformly expanded by inserting a tube expander plug into the grooved-inner-surface heat transfer tube 1. Additionally, if H2 is taller than 90% of H1, then the ribs 14 are too hard so that the cross-sectional shape of the rounded portion does not form a clean elliptical shape when the grooved-inner-surface heat transfer tube 1 is rounded. A normal grooved-inner-surface heat transfer tube 1 having an outer diameter of 10 mm or less should preferably have ribs which have a height of 0.05~0.15 mm from the inner surface. The same applies to the ribs 18.

The cross-sectional shape of the fins 2 and the angle γ (apex angle) between the side surfaces of the fins 2 should preferably be similar to those of Embodiment 1.

With the grooved-inner-surface heat transfer tubes according to the above embodiment, ribs 14 are formed to couple the bending points of the fins extending in zigzag fashion, so that even when the grooved-inner-surface heat transfer tube 1 is rounded into a U-shape, the gaps between the bending portions of the fins 2 can be prevented from inordinately expanding in comparison to other parts due to the tensile strength of the ribs 14. Consequently, the area around the tip portions of the fins 2 bumps are not formed along the outer surface of the grooved-inner-surface heat transfer tube 1, so that it is possible to prevent blemishes in the appearance due to the formation of the bumps and prevent reductions in the reliability of the grooved-inner-surface heat transfer tube 1 due to thinning at the bumps.

Additionally in the present embodiment, the fins 2 formed on the inner surface are arranged so as to make two pairs of V-shapes which open in the upstream direction of flow with respect to a heat transfer medium flowing in either direction, so that the heat transfer medium which is collected by the side surfaces of the fins 2 is combined at the adjoining portions of the V-shapes and flows over the adjoining portions. Since the heat transfer medium is agitated to generate a chaotic turbulent flow during this process, temperature gradients can be prevented from occurring within the flow of the heat transfer medium and it is thus possible to promote heat transfer between the heat transfer medium and the metallic surfaces of the heat transfer tube to increase the heat transfer efficiency. Specifically, separation of heat transfer medium components can be prevented when a mixed heat transfer medium (a mixture of a plurality of heat transfer media) is used, so as to draw out the performance capabilities of the original mixed transfer medium.

Additionally, while obtaining the exceptional agitation effects mentioned above, the heat transfer medium is able to comparatively easily pass over the adjoining portions of the fins 2 because of the formation of the ribs 14 at the adjoining portions of the fins 2, so that the present embodiment also offers the advantage that the flow resistance is not heavily increased.

Embodiment 19

Figure 26:
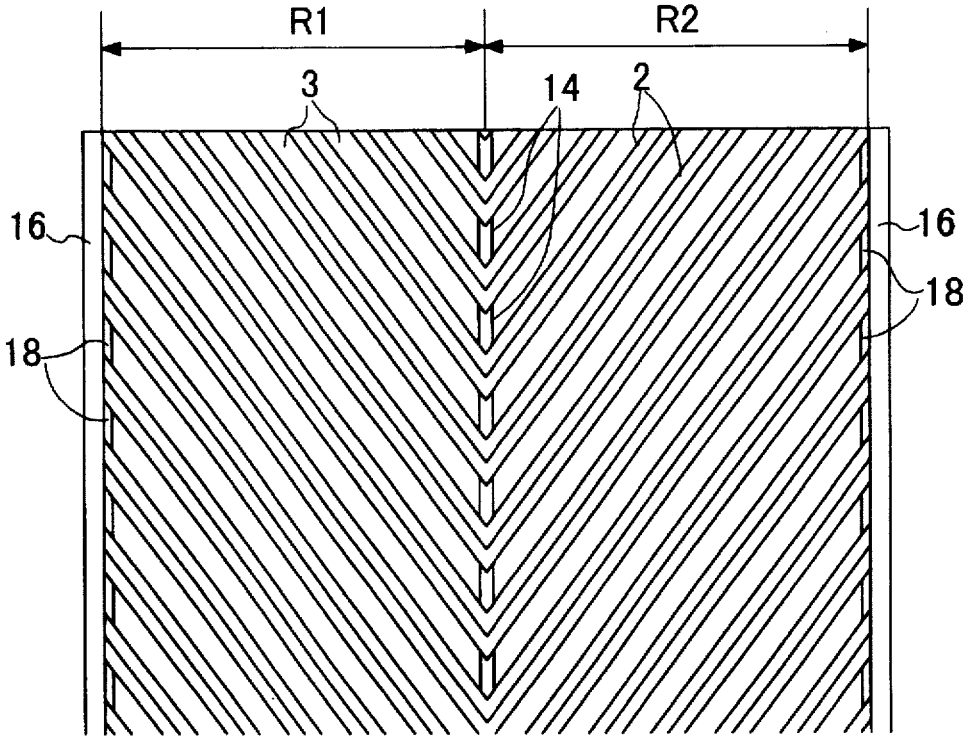
FIG. 26 is a spread-open view showing the inner surface of a tube according to another embodiment.

FIG. 26 shows a nineteenth embodiment of the present invention. While the inner surface of the grooved-inner-surface heat transfer tube 1 is separated into four regions R1~R4 along the circumferential direction in Embodiment 18, the inner surface is divided into only two regions R1 and R2 in the circumferential direction in the present example. Consequently, if the outer diameter of the heat transfer tube is the same, then the length of the fins is approximately doubled in comparison to the previous embodiment. The other features are identical to those of the above-mentioned embodiments.

According to Embodiment 19 of this type, the area around the end portions of the fins 2 does not bulge from the outer surface of the grooved-inner-surface heat transfer tube 1 to form bumps, because of the tensile strength of the ribs 14, so that it is possible to prevent blemishes due to the formation of the bumps and the prevent reductions in the reliability of the grooved-inner-surface heat transfer tube 1 due to thinning at these bump portions.

Embodiment 20

Figure 27:
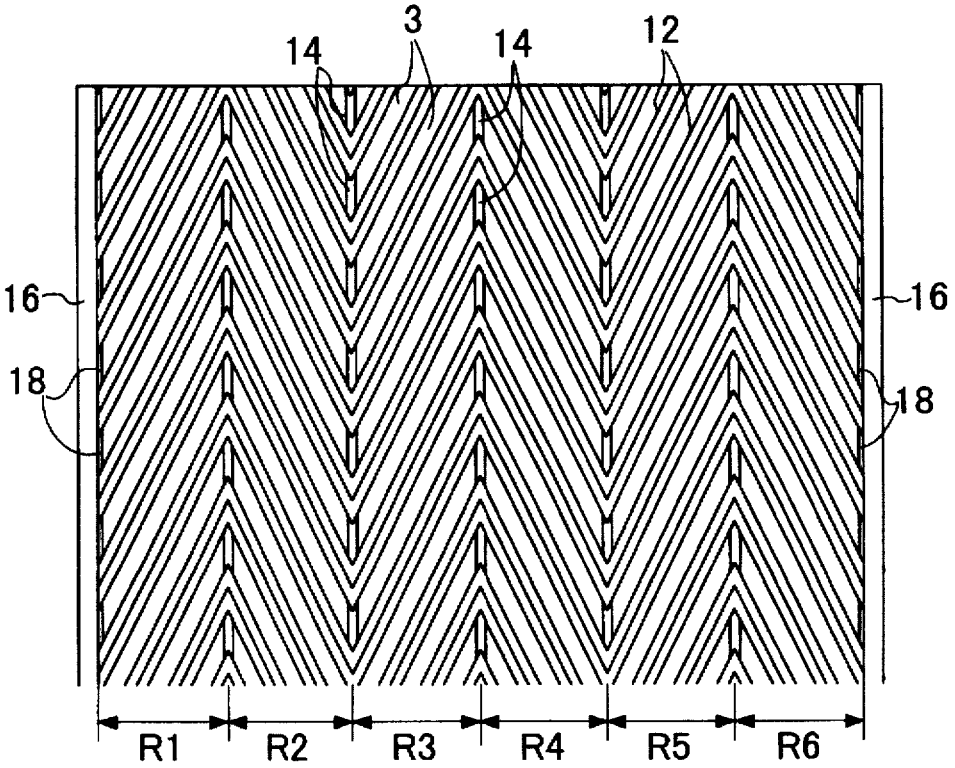
FIG. 27 is a spread-open view showing the inner surface of a tube according to another embodiment.

FIG. 27 shows a twentieth embodiment of the present invention. The present embodiment is characterized in that the inner surface of the grooved-inner-surface heat transfer tube 1 is divided into six regions R1~R6. Each of these regions R1~R6 has a plurality of mutually parallel fins along the axial direction of the grooved-inner-surface heat transfer tube 1. The other features are identical to those of Embodiment 18, so they have been given the same reference numerals and their explanations are omitted. The same remarkable effects offered by Embodiment 18 are able to be obtained by means of a grooved-inner-surface heat transfer tube 1 according to this structure as well.

With the grooved-inner-surface heat transfer tube of this type as well, the inner surface of the heat transfer tube can be divided into eight or more regions if the outer diameter of the heat transfer tube is large, and the fins can be formed into arcuate shapes if necessary. Furthermore, it is possible to form grooves on the tops of the bending portions of the fins 2, with the height of the bottom portions of the grooves being matched with the height of the ribs 14. When grooves are formed in this manner, the heat transfer medium is made to flow through these grooves, so that the flow resistance of the heat transfer medium flowing in the grooved-inner-surface heat transfer tube 1 is able to be further reduced while further reducing the chances of bump formation by reducing the hardness of the tips of the bending portions of the fins 2.

Example of Rollers for Producing Grooved-Inner-Surface Heat Transfer Tube

Next, an example of a roller used for producing the grooved-inner-surface heat transfer tubes of the present invention will be explained.

Figure 28:
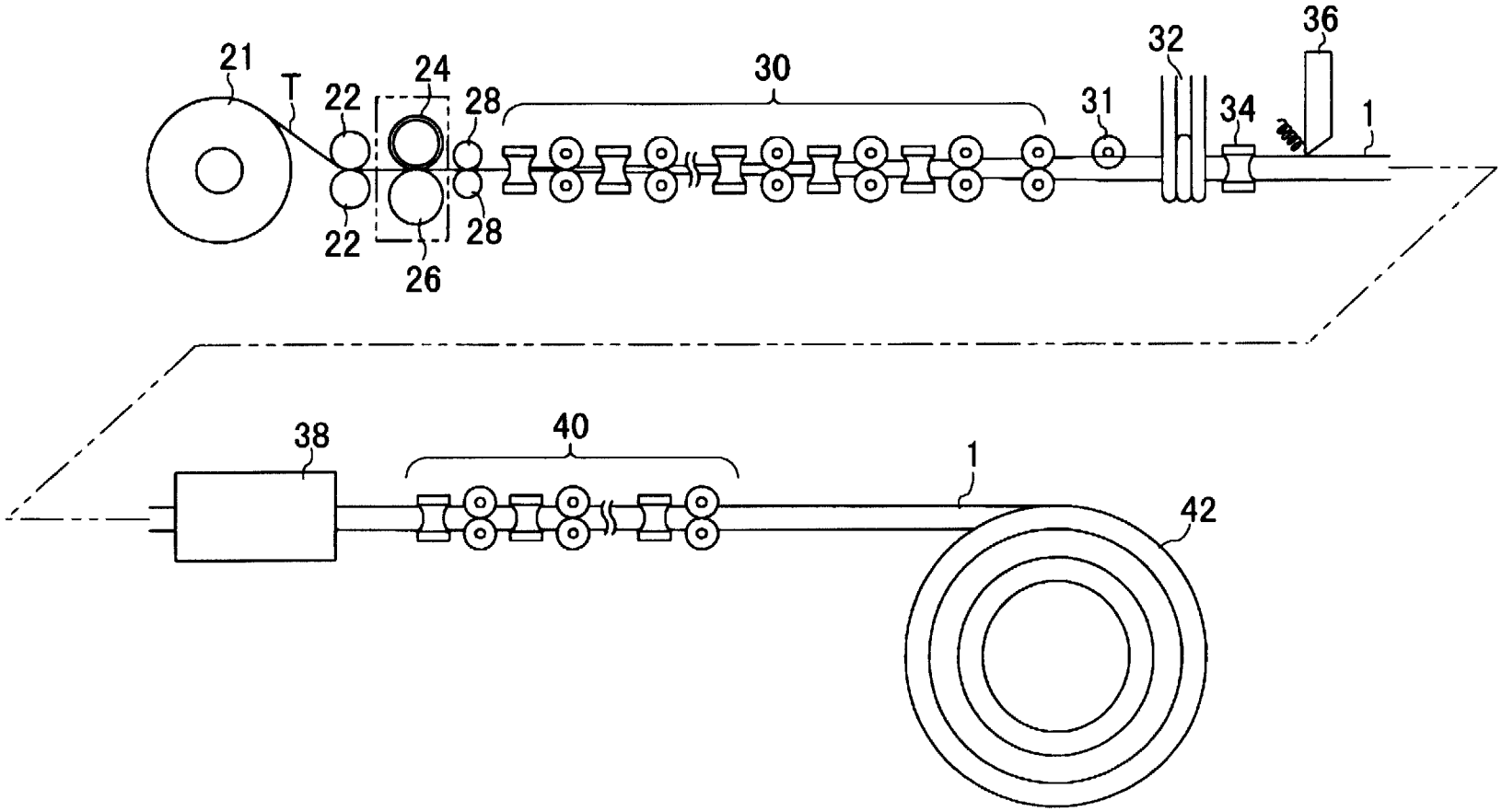
FIG. 28 is an overall view showing a heat transfer tube production apparatus.

FIG. 28 shows an apparatus for producing the grooved-inner-surface heat transfer tube of Embodiment 18, starting with a summary explanation of the structure of this apparatus. In the drawings, reference numeral 21 denotes an uncoiler for continuously delivering a metallic board material T having a constant width; the delivered board material T is passed through a pair of presser rollers and between a grooved roller 24 and a smooth roller 26 which form a pair, thereby forming fins 12 and grooves 13 by means of the grooved roller 24. The grooved roller 24 and the smooth roller 26 can be driven in synchronization with the advancement of the board material T, or may simply rotate passively without being driven. The grooved roller 24 is the roller for producing the grooved-inner-surface heat transfer tube of the present invention.

After grooves are formed on the board material T by means of the grooved roller 24 and the smooth roller 26, the board material T passes through a pair of rollers 28 and is then gradually rounded into a tube-shape by passing through a plurality of pairs of forming rollers 30. While the space between the edges of the board material which are to be adjoined is held constant by a rolling separator 31, the edges are heated by passing through an induction heating coil 32. The board material T which has been shaped into a tube and heated is passed through a pair of squeeze rollers 34 so that the heated edge portions are adjoined by means of pressure from both sides, and welded. Beads due to melted material which has been pinched out are formed on the outer surface of the grooved-inner-surface heat transfer tube 1 welded in this manner, and these beads are removed by a bead cutter 36.

The grooved-inner-surface heat transfer tube 1 which has had the beads removed is forcibly cooled by passing through the cooling tank 38, and is shrunk to a designated outer diameter by passing through a plurality of pairs of sizing rollers 40.

Figure 29:
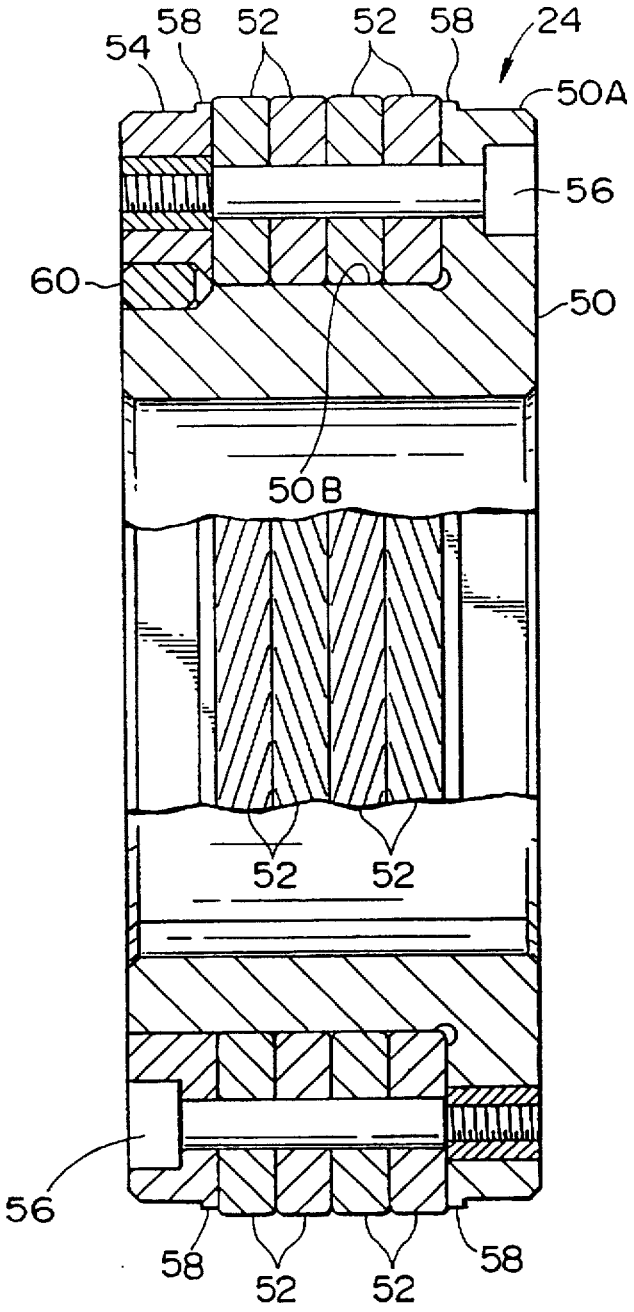
FIG. 29 is a section view showing an embodiment of a roll for producing the embodiment shown in FIG. 23.

FIG. 29 is a section view cut along the axis of the grooved roller 24 in the present invention. The grooved roller 24 has a roller main body 50 comprising a thin diameter portion 50B having a cylindrical shape and a ring-shaped flange portion 50A formed coaxially with one end of this thin diameter portion 50B in the axial direction. Four ring-shaped roller components 52 having the same dimensions are passed around the thin diameter portion 50B of the roller main body 50, and a pressing ring 54 is further provided. Then, bolts 56 which pass through the flange portion 50A, the four roller components 52 and the pressing ring 54 are at standard intervals around the circumferential direction of the flange portions 50A, so as to forcibly unify these elements. A knock pin 60 is attached between the inner circumference of the pressing ring 54 and the outer circumference of the thin diameter portion 50B, so as to prevent the pressing ring 54 from loosening. Additionally, A ring-shaped roller surface 58 for pressing the grooveless portion 16 is formed adjacent to the roller components 52 on the outer circumferential surfaces of the pressing ring 54 and the flange portion 50A.

While four roller components 52 are used in the grooved roller 24 because the grooved-inner-surface heat transfer tube of Embodiment 18 is divided into four regions R1~R4, the widths and number of roller components 52 can be changed to suit the situation if the number of regions is different.

Figure 30:
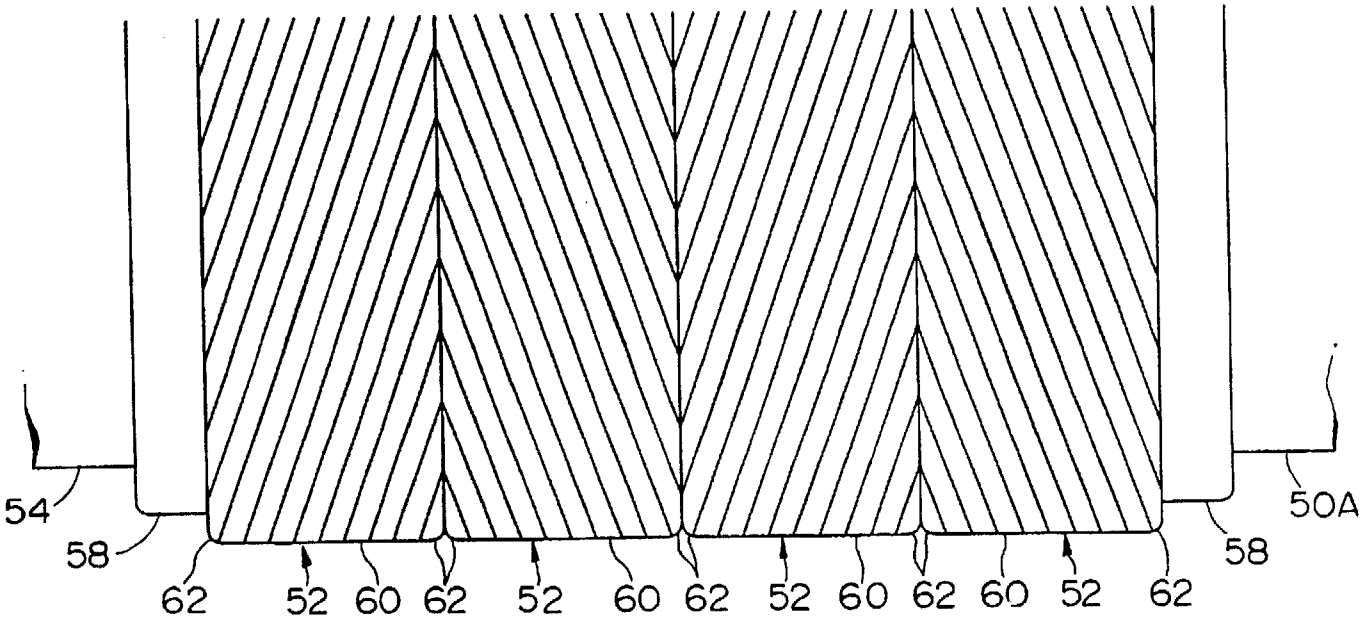
FIG. 30 is an enlarged front view showing a portion of the roll shown in FIG. 29.

As shown in FIG. 30, the outer circumferential surfaces of the roller components 52 have fin forming grooves 60 for forming the fins 2 on the surface of the board material T. These fin forming grooves 60 have a spiral shape with the axis of the roller component 52 as the central axis, and the orientation of the inclination angles of the fin forming grooves 60 with respect to the circumferential direction reverses between adjacent roller components 52. The cross-sectional shape of the fin forming grooves 60 is complementary with the shape of the fins 2, and the open edges 60A of the fin forming grooves 60 is chamfered depending upon need. On the other hand, the open edges 60A do not have to be chamfered if there is no need thereof.

The principal feature of the grooved roller 24 according to the present invention is that the outer circumferential edges on both ends with respect to the axial direction of the roller components 52 are chamfered around their entire circumferences, so as to form chamfered portions 62. Since there is no need to perform this type of chamfering procedure in conventional roller seams, rollers of this type with chamfering capabilities do not conventionally exist. By forming chamfered portions 62 in this manner, pairs of chamfered portions 62 come together to form grooves at the boundary of the layered roller components 52. These grooves form ribs 14 on the surface of the board material T.

Figure 31:
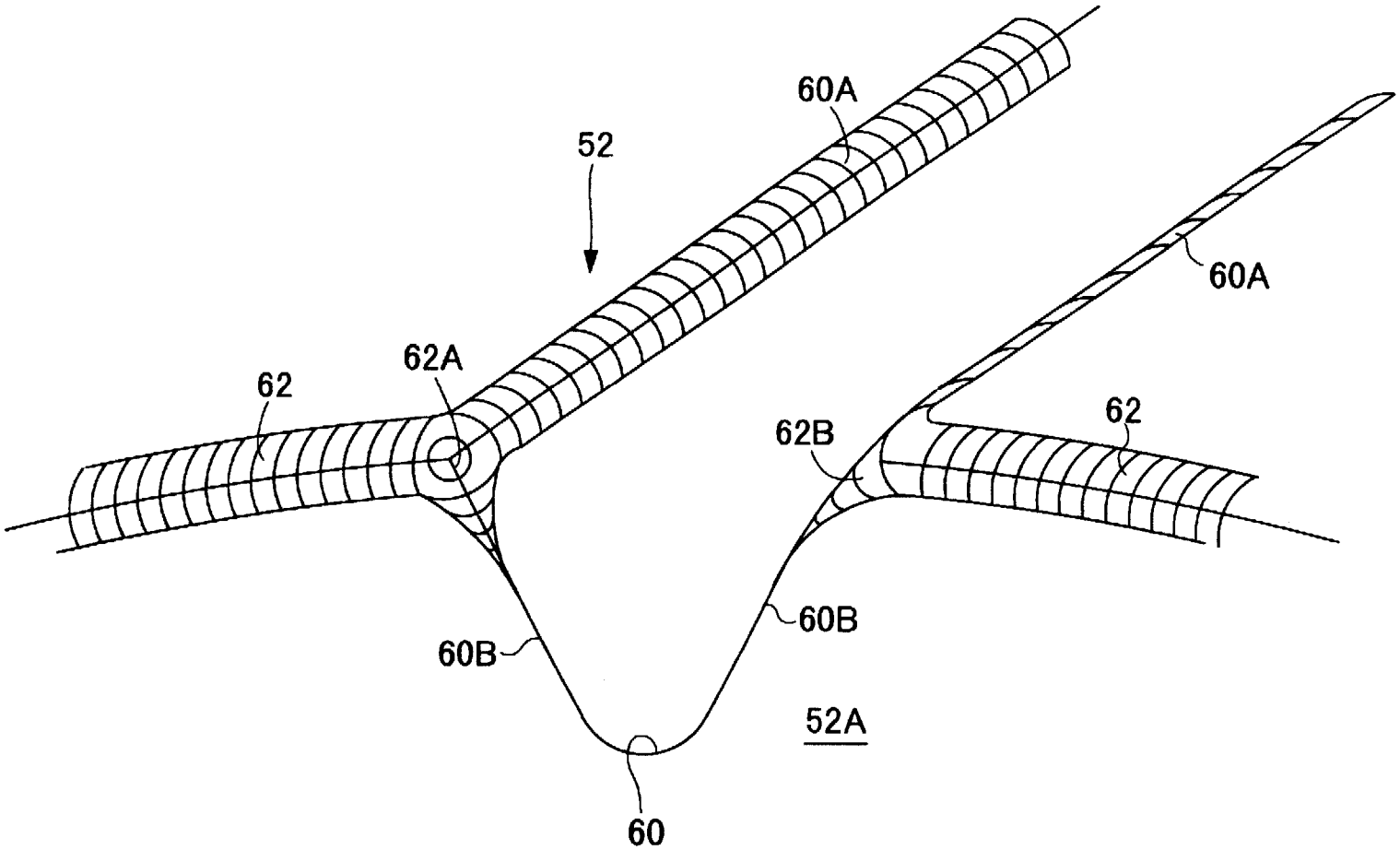
FIG. 31 is an enlarged perspective view showing a portion of the roll shown in FIG. 29.

FIG. 31 is an enlarged perspective view of the chamfered portions 62. The chamfered portions 62 are only formed on the boundary between the end surfaces 52A of the roller components 52 and the outer circumferential surface, so that the inner surface side of the edge 60B between the inner surfaces of the fin forming grooves and the end surfaces 52A of the roller components 52 are not chamfered. The reason is that if these portions are chamfered, the height of the fins becomes extremely high in localized areas.

The cross-sectional shapes of the chamfered portions 62 are not especially restricted; for example, they may be of any cross-sectional shape which is able to be formed by a normal chamfering process, such as arcuate shapes, linear shapes, or elliptical shapes. The degree of chamfering should be decided by considering the height of the ribs 14 to be formed, but a generally suitable example is to make the radius of curvature of the chamfered portions 62 in the range of R=0.05~0.1 mm.

In this case, the roller circumferential side portion of the edge 60B between the inner surface of the fin forming grooves 60 and the end surface 52A should preferably be simultaneously chamfered to a radius of curvature in the range of R=0.05~0.1 mm at the side 62A where the fin forming grooves 60 and the end surfaces 52A intersect at an obtuse angle, and the side 62B where the fin forming grooves 60 and the end surface 52A intersect at an acute angle should preferably chamfered to a radius of curvature in the range of R=0.05~0.2 mm relatively larger than the obtuse angle side. In this way, the effect of preventing cracks in the acute-angled end portion 62B during groove rolling can be achieved by chamfering the side 62B where the fin forming grooves 60 and the end surface 52A intersect at an acute angle relatively more than the obtuse angle side 62A.

Examples of methods for forming the chamfered portions 62 are polishing by means of a polisher such as a scotch buff, grinding with various types of whetstone, or blasting by means of shot, sand or beads. Blasting is most preferable because the chamfered portions 62 are able to be hardened by the process.

With the roller 24 for producing a grooved-inner-surface heat transfer tube according to the above structure, it is possible to easily produce heat transfer tubes offering the above-mentioned effects. Additionally, the side 62B where the fin forming grooves 60 and the end surface 52A intersect at an acute angle is chamfered so as to prevent cracks in the acute-angled end 62B during groove rolling.

Of course, the structure for mutually anchoring the roller components 52 is not restricted to the structure shown in the drawings, and changes may be made as appropriate.

While a number of embodiments of the present invention have been described above, the present invention is not restricted to the above embodiments, and the structures of the embodiments may of course be combined as appropriate.

EXPERIMENTAL EXAMPLES

Experiment 1

A comparative evaluation was made between the grooved-inner-surface heat transfer tubes (electrical seam welded tubes) shown in FIGS. 1, 3 and 4, and conventional grooved-inner-surface heat transfer tubes (electrical seam welded tubes) having simple spiral grooves.

First, seven types of heat transfer tubes A1~A3, B1~B4 having different combinations for the planar shape and cross-sectional shape of the fins were made, and the heat transfer efficiencies of these heat transfer tubes were compared. The outer diameters of these heat transfer tubes were made uniform at 9.52 mm, and their average thicknesses were also made equal.

The patterns of the fins were made into four types: spiral (conventional product), V-shaped (two regions, corresponding to the embodiment of FIG. 3), W-shaped (four regions, corresponding to the embodiment of FIG. 1) and VVV-shaped (six regions, corresponding to the embodiment of FIG. 4). The angle of inclination of the fins with respect to the axis of the heat transfer tube was made 15° in the spiral-type heat transfer tubes, and the other types all had angles of $\alpha$=15° and $\beta$=15°.

The cross-sectional shapes of the fins were made into two types: a tall type wherein the fins are tall and thin, and a short type (conventional type) wherein the fins are short and wide. The measurements of the fins of these two types are as shown in Table 1. Additionally, the completed grooved-inner-surface heat transfer tubes A1~A3 and B1~B4 had the structures shown in Table 2.

TABLE 1

| | Tall Fins | Short Fins |
|---|---|---|
| Pitch of Fins (P) | 0.36 mm | 0.36 mm |
| Height of Fins (H) | 0.24 mm | 0.15 mm |
| Apex Angle of Fins (γ) | 17° | 40° |
| Width of Groove Portions 3 | 0.22 mm | 0.19 mm |

TABLE 2

| | Short Fins | Tall Fins |
|---|---|---|
| Spiral Type | A1 | B1 |
| V-shaped Type | A2 | B2 |
| W-shaped Type | A3 | B3 |
| VVV-shaped Type | — | B4 |

Figure 34:
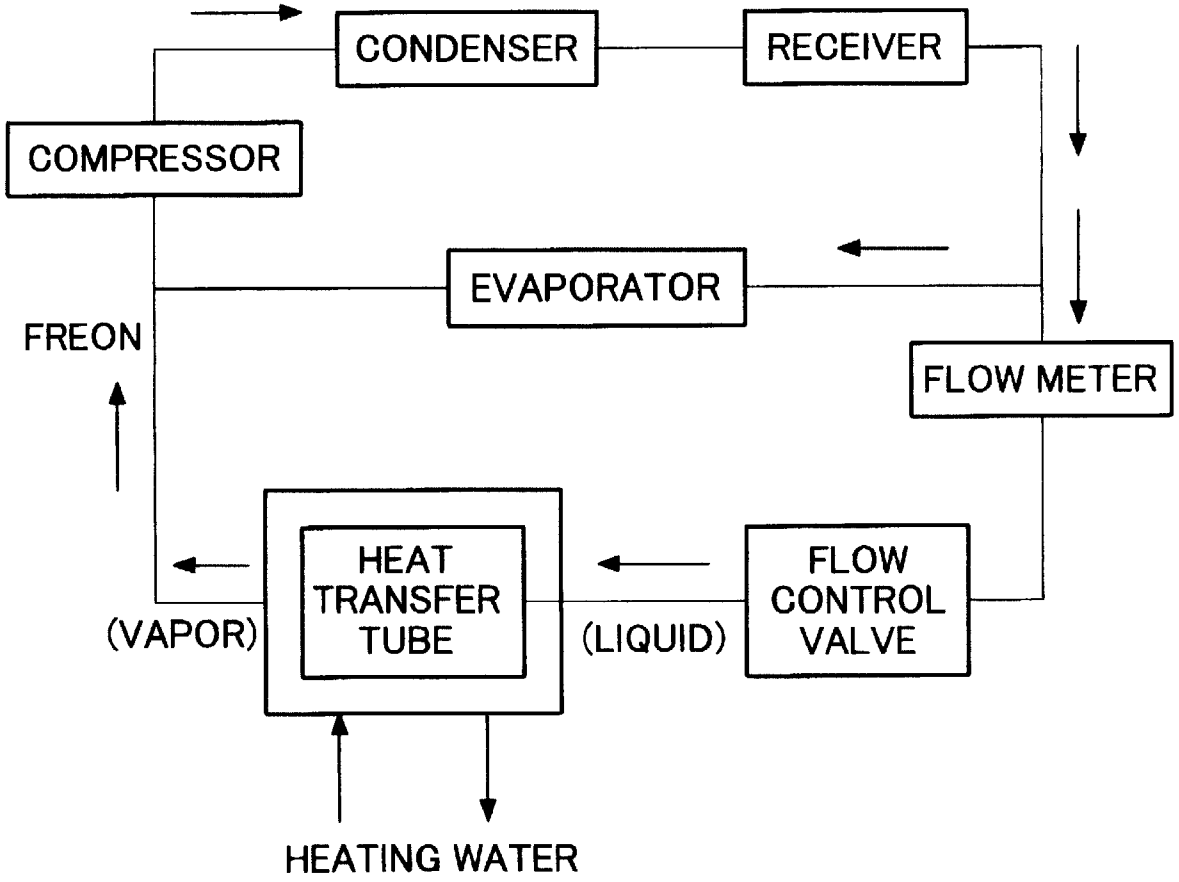
FIG. 34 is a schematic illustration showing a vaporization performance measurement device for heat transfer tubes having grooved inner surfaces.
Figure 35:
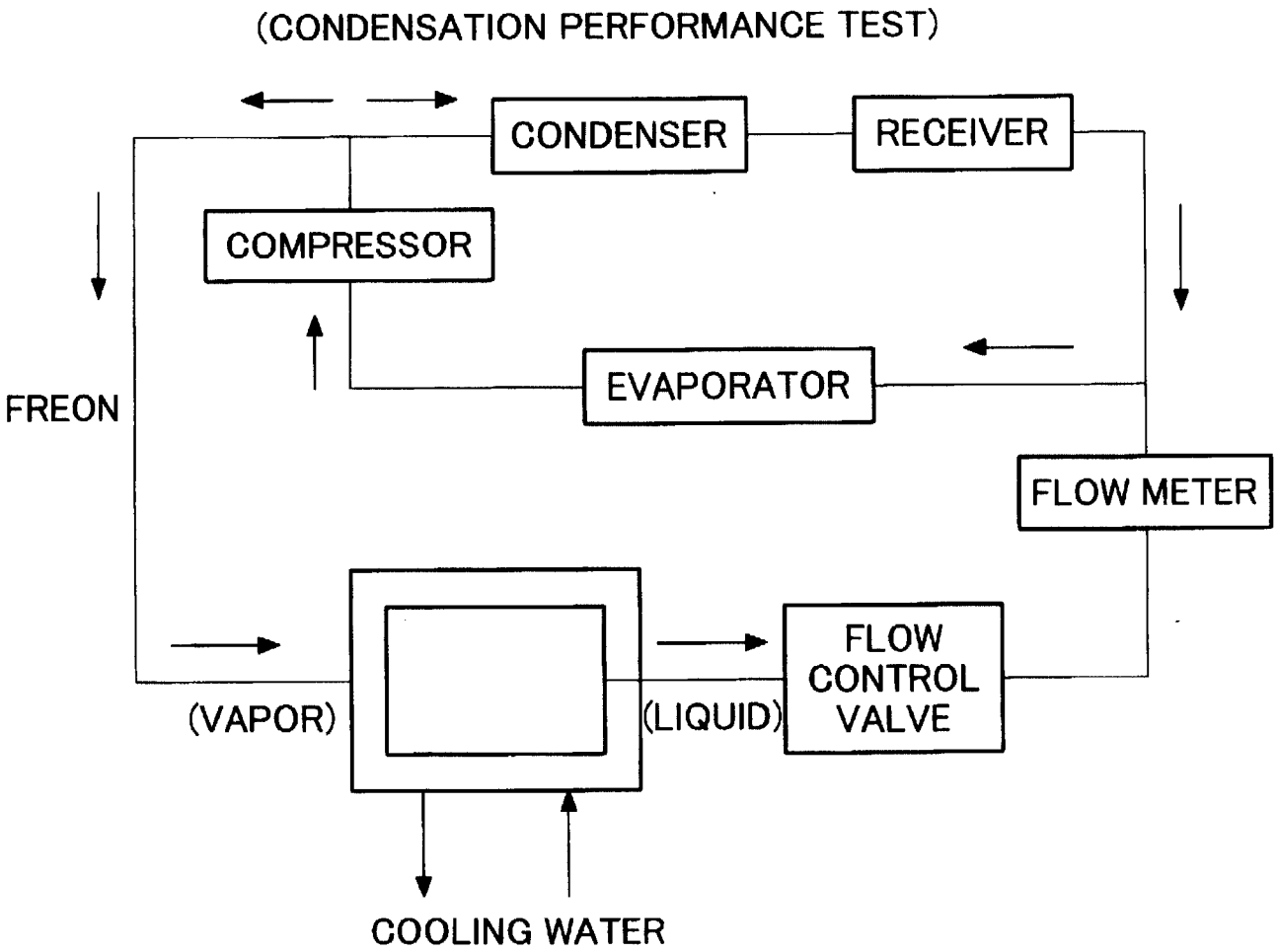
FIG. 35 is a schematic illustration showing a condensation performance measurement device for heat transfer tubes having grooved inner surfaces.

Next, the heat transfer performance (vaporization performance, condensation performance) of each of the resulting heat transfer tubes A1~A3 and B1~B4 was measured using the apparatus shown in FIGS. 34 and 35. During the measurement, each of the heat transfer tubes was set at the measurement portion in the drawings so as to measure the vaporization performance and the condensation performance according to the following evaluation methods. The evaluation conditions are shown below.

| Evaluation Method |
|---|
| Counterflow Double-Tube System Current Speed: 1.5 m/s |
| Overall Length of Heat Transfer Tube: 3.5 m |
| Saturation Temperature During Vaporization: 5° C. |
| Degree of Superheat 3 deg |
| Saturation Temperature During Vaporization: 45° C. |
| Degree of Superheat 5 deg |
| Heat Transfer Medium: Freon R-22 (trade name) |

Figure 36:
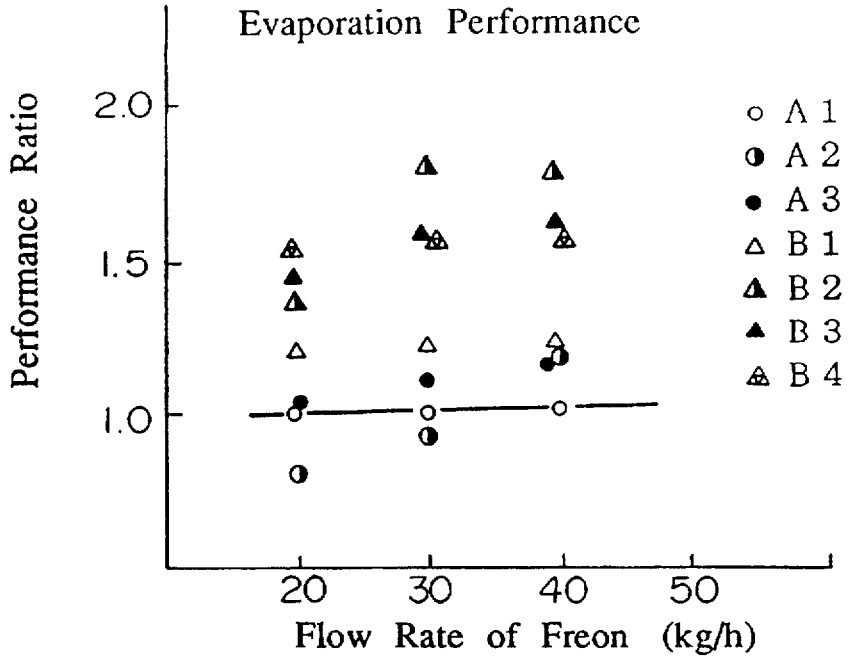
FIG. 36 is a graph showing the results of Experiment 1 (vaporization performance).
Figure 37:
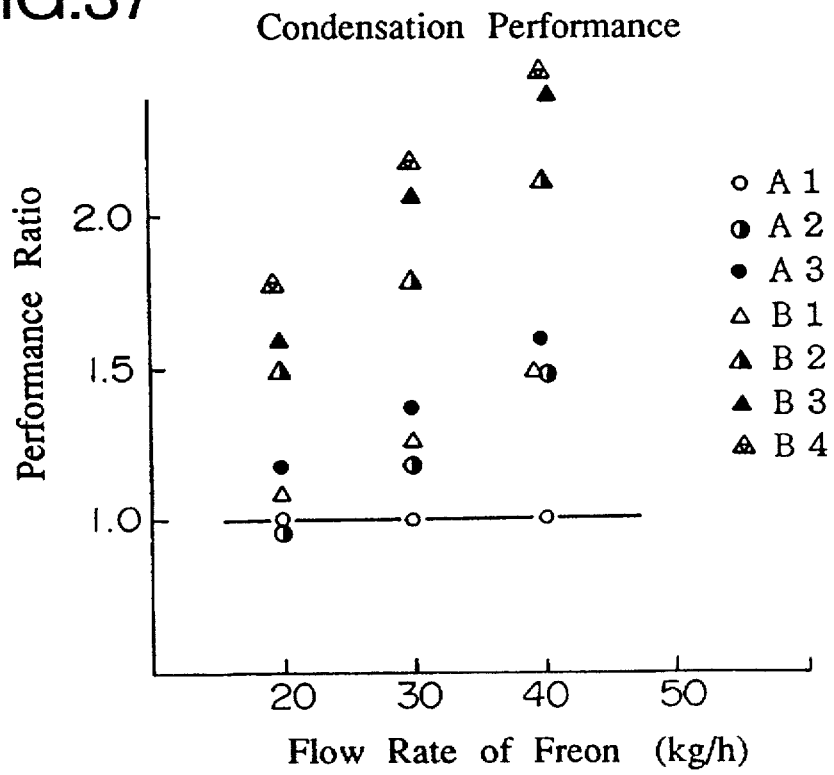
FIG. 37 is a graph showing the results of Experiment 1 (condensation performance).

The results of the above experiment are shown in FIGS. 36 and 37 as a ratio with respect to the vaporization performance, condensation performance and the pressure loss values for the A1-type heat transfer tube. As is apparent from these graphs, the V-shaped A2 and B2, the W-shaped A3 and B3, and the VVV-shaped B4 type heat transfer tubes exhibited exceptional vaporization performance and condensation performance in comparison the A1 type with simple spiral-shaped fins, especially when the rate of flow of the heat transfer medium was large.

Additionally, the B2, B3 and B4 types using tall fins exhibited good vaporization performance and condensation performance even when the rate of flow of the heat transfer medium was comparatively small.

Experiment 2

The heat transfer efficiencies of the embodiments of FIGS. 1, 3, 4, 5, 8 and 9 were compared with those of conventional simple spiral grooved heat transfer tubes.

The following eight types of heat transfer tubes which differ only in the shapes of the fins were made, and the heat transfer efficiencies and pressure loss of these heat transfer tubes were compared. The outer diameters of the heat transfer tubes were made uniform at 9.52 mm, and their average thicknesses were also made equal.

a1 type: Heat transfer tube with spiral grooves formed on the inner surface (conventional product).

b1 type: Heat transfer tube with two rows of fins formed so as to make a single V-shape on the inner surface, without gaps formed between adjacent fins in the circumferential direction (Embodiment of FIG. 3).

c1 type: Heat transfer tube with four rows of fins formed so as to make two pairs of V-shapes on the inner surface, without gaps formed between adjacent fins in the circumferential direction (Embodiment of FIG. 1).

d1 type: Heat transfer tube with six rows of fins formed so as to make three pairs of V-shapes on the inner surface, without gaps formed between adjacent fins in the circumferential direction (Embodiment of FIG. 4).

c2 type: Heat transfer tube with four rows of fins formed so as to make two pairs of V-shapes on the inner surface, having gaps formed between adjacent fins in the circumferential direction (Embodiment of FIG. 5).

d2 type: Heat transfer tube with six rows of fins formed so as to make three pairs of V-shapes on the inner surface, having gaps formed between adjacent fins in the circumferential direction (Embodiment of FIG. 8).

c3 type: Heat transfer tube with four rows of fins formed so as to make two pairs of V-shapes on the inner surface, having gaps formed between adjacent fins which are offset by a half-pitch in the circumferential direction (Embodiment of FIG. 9).

d3 type: Heat transfer tube with six rows of fins formed so as to make three pairs of V-shapes on the inner surface, having gaps formed between adjacent fins which are offset by a half-pitch in the circumferential direction (Embodiment of FIG. 5).

With respect to the following measurements, all of the heat transfer tubes had the same values.

Pitch of Fins P=0.36 mm

Height of Fins H=0.24 mm

Apex Angle of Fins γ=17°

(cross-sectional angle of fins in a cross section orthogonal to the tube axis=20°)

Width of Groove Portions 3=0.22 mm (width of grooves in axial direction=0.85 mm)

The angle of inclination of the fins with respect to the axis of the heat transfer tube was made 15° in the spiral-type heat transfer tubes, and the other types all had angles of α=15° and β=−15°. The width of the gaps C1 in the c2 and d2 type heat transfer tubes was 0.2 mm, while the width C2 in the c3 and d3 type heat transfer tubes was 0.2 mm as well.

Next, the heat transfer performance (vaporization performance, condensation performance) of the resulting heat transfer tubes was measured by using the apparatus shown in FIGS. 34 and 35. During the measurement, the heat transfer tubes were set at the measurement portions in the drawings, and the vaporization performance and condensation performance were measured by the following evaluation method. At the same time, the pressure loss was measured. The evaluation conditions were as follows.

| Evaluation Method |
|---|
| Counterflow Double-Tube System Current Speed: 1.5 m/s |
| Overall Length of Heat Transfer Tube: 3.5 m |
| Saturation Temperature During Vaporization: 5° C. |
| Degree of Superheat 3 deg |
| Saturation Temperature During Vaporization: 45° C. |
| Degree of Superheat 5 deg |
| Heat Transfer Medium: Freon R-22 (trade name) |

Figure 38:
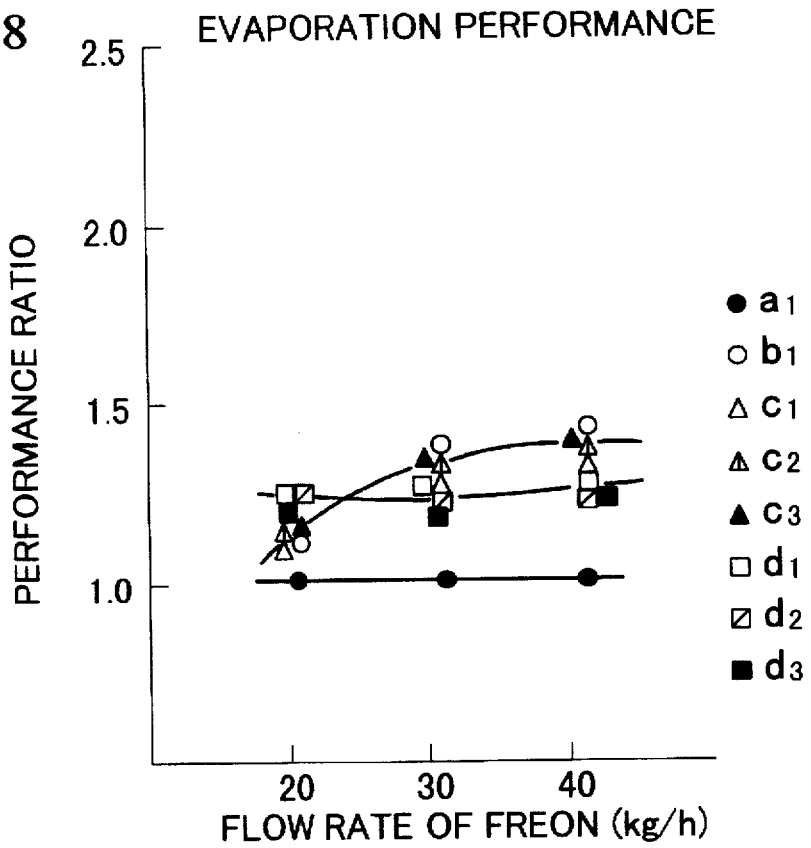
FIG. 38 is a graph showing the results of Experiment 2 (vaporization performance and pressure loss during vaporization).
Figure 38:
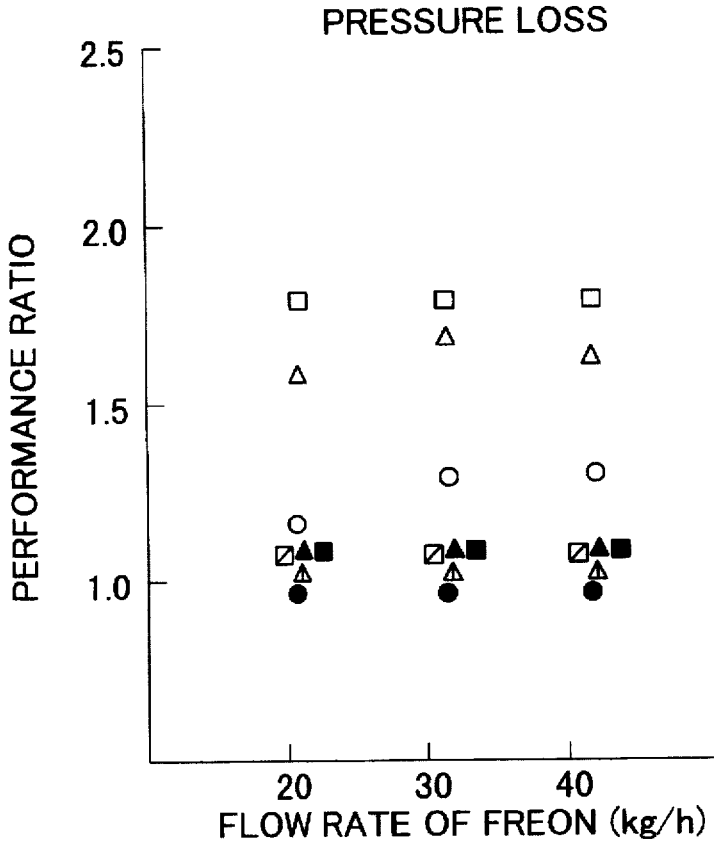
Figure 39:
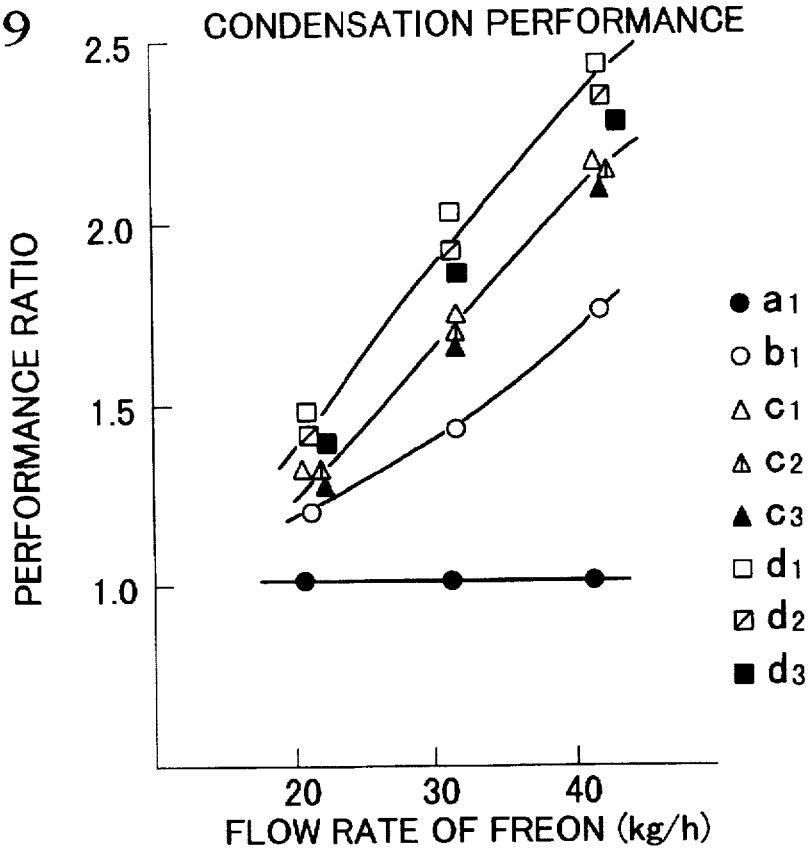
FIG. 39 is a graph showing the results of Experiment 2 (condensation performance and pressure loss during condensation).
Figure 39:
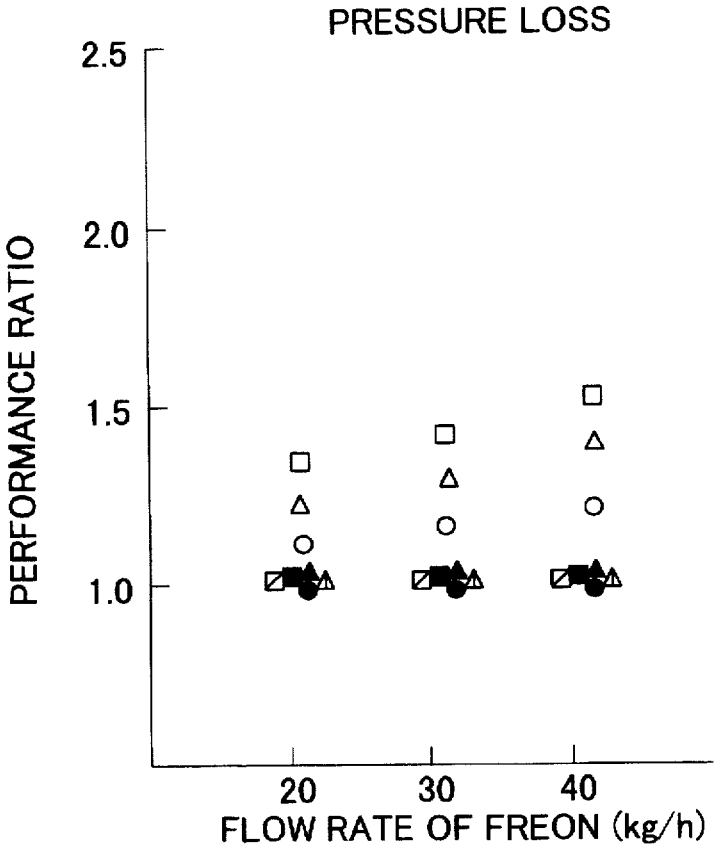

The results of the above experiment are shown in FIGS. 38 and 39 as a ratio with respect to the vaporization performance, condensation performance and the pressure loss values for the a1-type heat transfer tube. As is apparent from these graphs, the c2, c3, d2 and d3 type heat transfer tubes exhibited high heat transfer performance while having approximately the same pressure loss as the simple grooved a1 type tube.

Experiment 3

A comparison was made between the heat transfer efficiencies of the embodiments shown in FIGS. 10 and 15~17, and a conventional simple spiral grooved heat transfer tube.

First, five types of heat transfer tubes E1~E5 differing in only the planar shapes of their fins were made. The planar shapes of the fins of each heat transfer tube were as follows.

E1: Simple spiral shape wherein the fin angles do not reverse (conventional product).

E2: Spiral shape wherein the fin angles reverse every 300 mm in the axial direction (FIG. 15).

E3: V-shape wherein the V-shaped fins reverse every 300 mm in the axial direction (FIG. 16).

E4: W-shape wherein the W-shaped fins reverse every 300 mm in the axial direction (FIG. 10).

E5: VVV-shape wherein the VVV-shaped fins reverse every 300 mm in the axial direction (FIG. 17).

The inclination angles of the fins with respect to the axis of the heat transfer tubes were $\alpha=15°$ and $\beta=-15°$, with the dimensions of the fins 2 being thinner and taller than in conventional products.

Pitch of Fins P=0.36 mm

Height of Fins H=0.24 mm

Apex Angle of Fins $\gamma=17°$

Width of Groove Portions 3=0.22 mm

Additionally, the grooved-inner-surface heat transfer tubes 1 had outer diameters of 8.0 mm, average thicknesses of 0.35 mm, and were made of copper material.

Next, the heat transfer performance (vaporization performance, condensation performance) of the resulting heat transfer tubes E1~E5 was measured by using the apparatus shown in FIGS. 34 and 35. During the measurement, the heat transfer tubes were set at the measurement portions in the drawings, and the vaporization performance and condensation performance were measured by the following evaluation method. At the same time, the pressure loss was measured. The evaluation conditions were as follows.

| Evaluation Method |
|---|
| Counterflow Double-Tube System Current Speed: 1.5 m/s |
| Overall Length of Heat Transfer Tube: 3.5 m |
| Saturation Temperature During Vaporization: 5° C. |
| Degree of Superheat 3 deg |
| Saturation Temperature During Vaporization: 45° C. |
| Degree of Superheat 5 deg |
| Heat Transfer Medium: Freon R-22 (trade name) |

Figure 40:
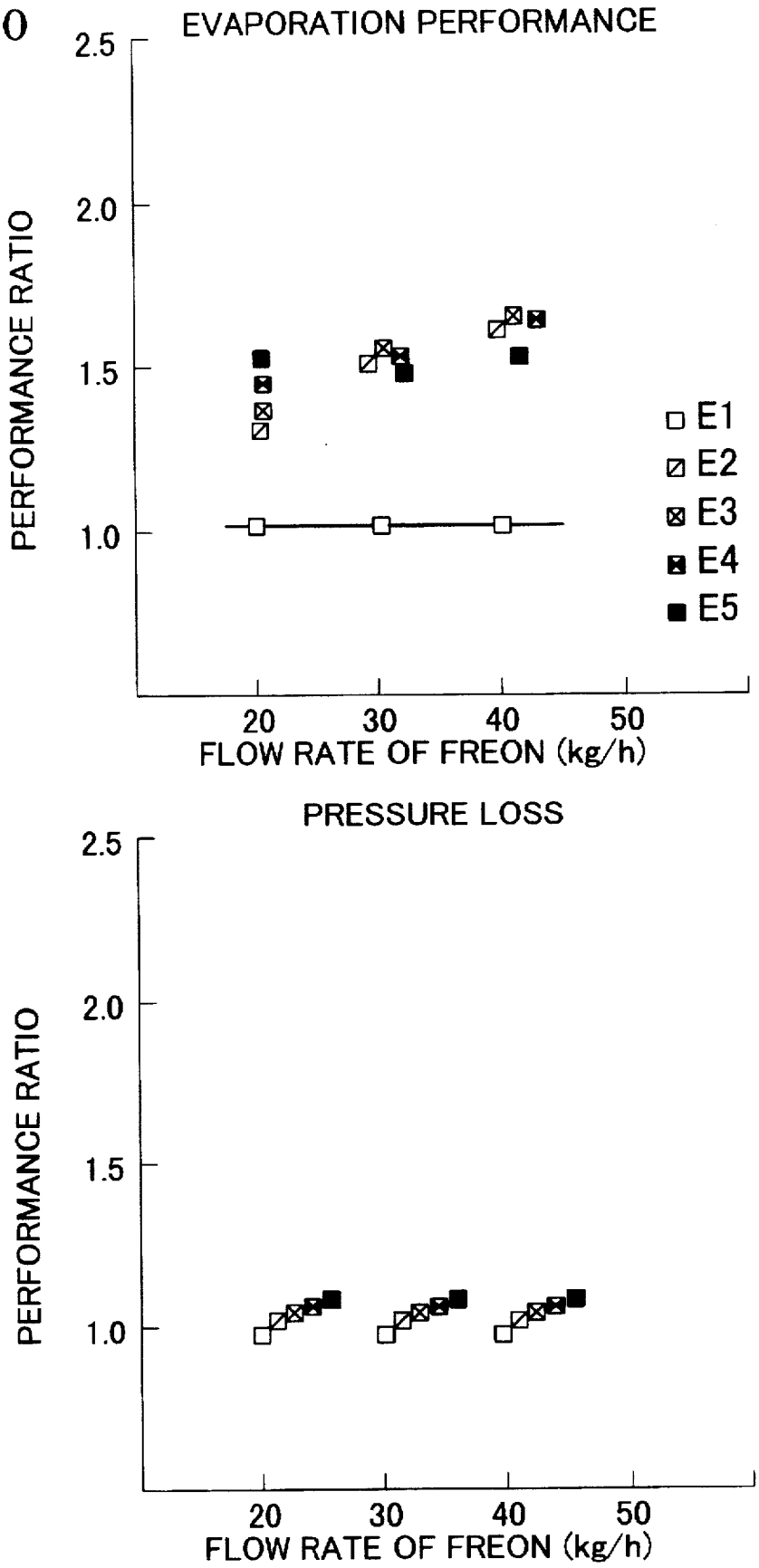
FIG. 40 is a graph showing the results of Experiment 2 (vaporization performance and pressure loss during vaporization).
Figure 41:
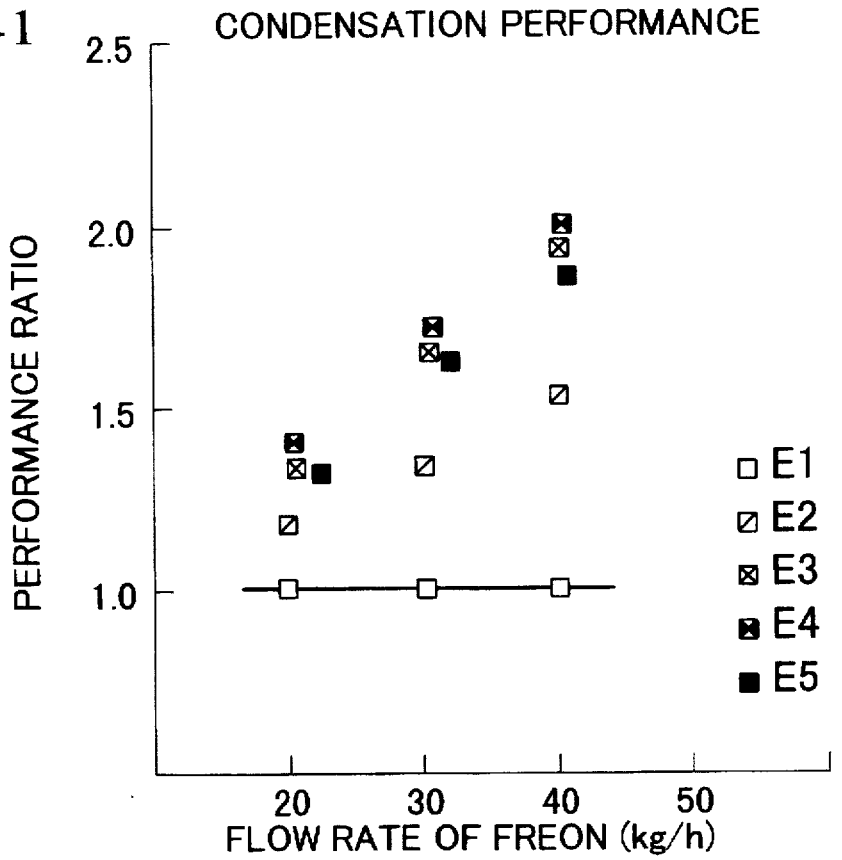
FIG. 41 is a graph showing the results of Experiment 2 (condensation performance and pressure loss during condensation).
Figure 41:
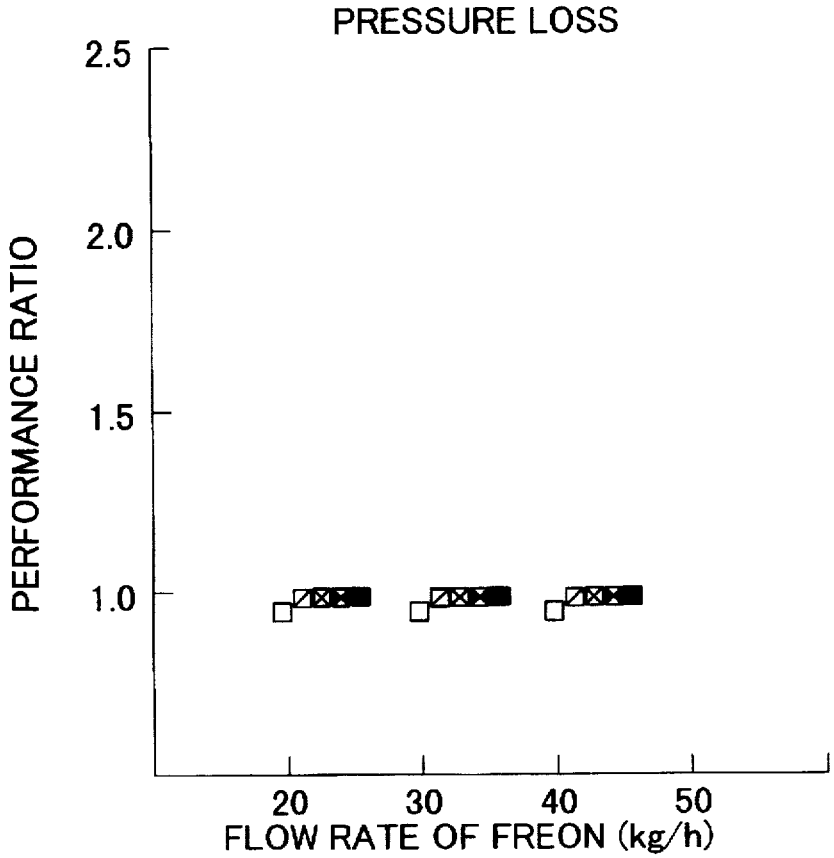

The results of the above experiment are shown in FIGS. 40 and 41 as a ratio with respect to the vaporization performance, condensation performance and the pressure loss values for the E1-type heat transfer tube. As is apparent from these graphs, the E2~E5 type heat transfer tubes wherein the inclination angles of the fins are reversed every standard interval in the axial direction exhibited somewhat high pressure loss but more than made up for this in the increase in vaporization performance and condensation performance. Additionally, the E3, E4 and E5 type heat transfer tubes exhibited superb condensation performance even among those wherein the fin angles were reversed.

We claim:

1. A heat transfer tube having a grooved inner surface; comprising:

a plurality of fins consecutively formed along a circumferential direction on an inner circumferential surface of a metallic tube; wherein said inner circumferential surface of said metallic tube is divided into at least two regions in the circumferential direction; an inclination angle of said fins is 10°~25° with respect to an axis of said metallic tube inside odd-numbered regions counting from one region among said regions, and an inclination angle of said fins is −10°~−25° with respect to the axis of said metallic tube inside even-numbered regions counting from said one region.

2. A heat transfer tube having a grooved inner surface according to claim 1, wherein said metallic tube is an electrical seam-welded tube, and said fins are separated by a weld line at a single location on said inner circumferential surface.

3. A heat transfer tube having a grooved inner surface according to claim 1, wherein the pitch of said fins is 0.3~0.4 mm, the height of said fins from said inner circumferential surface of said metallic tube is 0.15~0.30 mm, and the angle formed between the side surfaces of each of said fins is 10°~25°.

4. A heat transfer tube having a grooved inner surface according to claim 1, wherein the number of said regions is two, four or six.

5. A heat transfer tube having a grooved inner surface comprising:

a metallic tube having an inner circumferential surface which is divided into at least two regions along the circumferential direction; and a plurality of fins which are formed along the axial direction of said metallic tube in each of said regions; wherein an inclination angle of said fins is 10°~25° with respect to an axis of said metallic tube inside odd-numbered regions counting from one region among said regions, and an inclination angle of said fins is −10°—25° with respect to the axis of said metallic tube inside even-numbered regions counting from said one region; and gaps are formed between edge portions of said fins which are mutually adjacent in the circumferential direction.

6. A heat transfer tube having a grooved inner surface according to claim 5, wherein fins included within the same region are mutually parallel.

7. A heat transfer tube having a grooved inner surface according to claim 5, wherein fins included within adjacent regions are formed symmetrically with respect to the boundary line between the regions, and the width of said gaps is 0.05~0.5 mm.

8. A heat transfer tube having a grooved inner surface according to claim 5, wherein fins included within adjacent regions are formed with their pitches offset along the axial direction of said heat transfer tube, and the width of said gaps is 0.05~0.5 mm.

9. A heat transfer tube having a grooved inner surface, comprising:

a metallic tube having a plurality of fins, which are inclined with respect to the axial direction of said metallic tube, formed on an inner circumferential surface thereof;

wherein the orientation of an inclination angle of said fins with respect to the axial direction is reversed every designated interval in said axial direction and wherein each of said fins has a continuous zigzag shape along a circumferential direction of the inner surface of said metallic tube.

10. A heat transfer tube having a grooved inner surface, comprising:

a metallic tube having a plurality of fins, which are inclined with respect to the axial direction of said metallic tube, formed on an inner circumferential surface thereof;

wherein the orientation of an inclination angle of said fins with respect to the axial direction is reversed every designated interval in said axial direction and wherein each of said fins is divided into a plurality of portions along a circumferential direction on the inner surface of said metallic tube, and fins which are adjacent in a circumferential direction have opposite angles with respect to said axial direction.

11. A heat transfer tube having a grooved inner surface, comprising:

a metallic tube having a plurality of fins, which are inclined with respect to the axial direction of said metallic tube, formed on an inner circumferential surface thereof;

wherein the orientation of an inclination angle of said fins with respect to the axial direction is reversed every designated interval in said axial direction and wherein each of said fins is divided into a plurality of portions along a circumferential direction on the inner surface of said metallic tube, and fins which are adjacent in a circumferential direction have mutually equal angles with respect to said axial direction.

12. A heat transfer tube having a grooved inner surface according to claim 10, wherein gaps are formed between end portions of said fins which are adjacent in the circumferential direction.

13. A heat transfer tube having a grooved inner surface; comprising:

a plurality of fins consecutively formed along a circumferential direction on an inner circumferential surface of a metallic tube; wherein said inner circumferential surface of said metallic tube is divided into at least two regions in the circumferential direction; an inclination angle of said fins has a positive value with respect to an axis of said metallic tube inside odd-numbered regions counting from one region among said regions, and an inclination angle of said fins has a negative value with respect to the axis of said metallic tube inside even-numbered regions counting from said one region; and ribs are formed for coupling bending points on said fins which are adjacent in an axial direction of said metallic tube.

14. A heat transfer tube having a grooved inner surface according to claim 13, wherein said metallic tube is an electrical seam-welded tube, and said fins are separated by a weld line at a single location on said inner circumferential surface.

15. A heat transfer tube having a grooved inner surface according to claim 13, wherein an amount of projection of said ribs from said inner circumferential surface of said metallic tube is 5~90% of an amount of projection of said fins from said inner circumferential surface of said metallic tube.

* * * * *